US006719410B2

(12) United States Patent
Shingai et al.

(10) Patent No.: US 6,719,410 B2
(45) Date of Patent: Apr. 13, 2004

(54) INK JET HEAD AND MANUFACTURING METHOD THEREOF

(75) Inventors: Tomohisa Shingai, Kawasaki (JP); Shuji Koike, Tokyo (JP); Yoshiaki Sakamoto, Kawasaki (JP)

(73) Assignee: Fujistu Limited, Kawasaki (JP)

( * ) Notice: Subject to any disclaimer, the term of this patent is extended or adjusted under 35 U.S.C. 154(b) by 0 days.

(21) Appl. No.: 10/166,616

(22) Filed: Jun. 12, 2002

(65) Prior Publication Data

US 2002/0191055 A1 Dec. 19, 2002

Related U.S. Application Data

(63) Continuation of application No. PCT/JP99/06993, filed on Dec. 13, 1999.

(51) Int. Cl.[7] ..... B41J 2/045
(52) U.S. Cl. ..... 347/70
(58) Field of Search ..... 347/54, 68–72; 29/25.35, 890.1; 310/324, 328

(56) References Cited

U.S. PATENT DOCUMENTS 5,818,482 A * 10/1998 Ohta et al. ..... 347/70
6,053,601 A * 4/2000 Watanabe et al. ..... 347/70
6,494,566 B1 * 12/2002 Kishino et al. ..... 347/70

FOREIGN PATENT DOCUMENTS

| | | |
|---|---|---|
| JP | 2-143861 | 6/1990 |
| JP | 8-116101 | 5/1996 |
| JP | 9-104109 | 4/1997 |

* cited by examiner

*Primary Examiner*—Stephen D. Meier
*Assistant Examiner*—An H. Do
(74) *Attorney, Agent, or Firm*—Armstrong, Kratz, Quintos, Hanson & Brooks, LLP

(57) ABSTRACT

An ink jet head using bimorph drivers and a manufacturing method thereof are disclosed. The head has pressure chambers 6 that each communicates with a nozzle 9 and stores ink, and bimorph drivers that each has a piezoelectric body 1 and a vibrating plate 2 and that are for applying pressure to the pressure chambers 6; three peripheral sides of each of the bimorph drivers are fixed, and the other side is not fixed. Since one side of the piezoelectric body of each of the bimorph drivers is made to be free, tensile stress can be released without pressure leakage. As a result, the displacement and pressure required for ejecting ink drops can be obtained even if the width of the piezoelectric bodies is narrow. A high-density multi-nozzle head can thus be realized.

7 Claims, 21 Drawing Sheets

INK JET HEAD AND MANUFACTURING METHOD THEREOF

This application is a continuation of International Application PCT/JP99/06993 filed Dec. 13, 1999.

TECHNICAL FIELD

The present invention relates to an ink jet head using a piezoelectric body and a manufacturing method thereof, and in particular to an ink jet head using a driving source having a bimorph structure and a manufacturing method thereof.

BACKGROUND ART

An ink jet printer carries out printing on sheets by ejecting ink particles from an ink chamber. An ink jet printer has a simpler constitution than an electro-photographic printer, and hence a low-cost printer can be provided. Moreover, color printing is possible with a low-cost apparatus. Ink jet printers thus constitute the mainstream of the low-cost printer market.

Types of ink jet printer are a piezoelectric type that uses a piezoelectric element, and a thermal type that uses a heat-generating element. The piezoelectric type has advantages not seen with the thermal type, namely the response speed is high and the electrical-mechanical energy conversion efficiency is high. The piezoelectric type is thus suited to high-resolution color printers.

With a high-resolution printer, there are problems if the volume of the ink drops is too large or too small. That is, in the case that the volume of the ink drops is too large, the gradation representation ability is insufficient, and hence the resolution drops. Conversely, if the volume of the ink drops is too small, then the printing speed drops, and also the ink flying direction is disturbed due to the influence of air currents and slight electrical charging, and hence the resolution drops. With most high-resolution printers, the volume of the ink drops is thus a few pico-liters (1 pico-liter=$10^{-12}$ of a liter=$10^{-15}$ of a cubic meter).

With a piezoelectric body as the driving source for ejecting the ink drops, the mechanical energy generated (generative force) is sufficiently large, but the displacement amount is low. A displacement magnifying mechanism that increases the displacement of the piezoelectric body is thus used. A bimorph structure is most widely used as a suitable displacement magnifying mechanism in an ink jet head.

FIG. 28(A), FIG. 28(B) and FIG. 28(C) are explanatory drawings of a conventional ink jet head. As shown in FIG. 28(A), the bimorph structure has a constitution in which a plate-shaped non-piezoelectric material (metal, ceramic etc.) 91 is stuck onto a plate-shaped piezoelectric body 90. The piezoelectric body 90 expands in the thickness direction, and at the same time contracts in the planar direction, and hence strain arises between the piezoelectric body 90 and the non-piezoelectric material 91, and to relieve this, warping occurs. The radius of curvature due to the warping is somewhat larger on the non-piezoelectric material 91 side (the outside), and is somewhat smaller on the inside of the piezoelectric body 90, and hence the length differs between the outside and the inside of the piezoelectric body 90. A large deformation thus arises for a very small strain (contraction in the planar direction) in the piezoelectric body 90.

An ink jet head using this bimorph driver is shown in FIG. 28(B) and FIG. 28(C). As shown in FIG. 28(B) and FIG. 28(C), nozzles 92 are provided in ink chambers 95 that store ink. A vibrating plate 91 is provided so as to form a wall for the ink chambers 95. The vibrating plate 91 corresponds to the non-piezoelectric material in FIG. 28(A). Piezoelectric bodies 90 are provided on the vibrating plate 91 in correspondence with each of the ink chambers 95. The ink chambers 95 communicate with an ink supply chamber 94 via an ink supply hole 93.

A voltage source 96 is connected between the vibrating plate 91 and the piezoelectric bodies 90, and by supplying a driving voltage, the piezoelectric plates 90 and the vibrating plate 91 are displaced, and pressure is applied to the ink chambers 95. As a result, ink drops are ejected from the nozzles 92 of the ink chambers 95. By releasing the driving voltage, the piezoelectric bodies 90 return to their original positions, and as a result ink is supplied from the ink supply chamber 94 into the ink chambers 95 via the ink supply hole 93.

The displacement amount depends on the width W of the piezoelectric bodies 90 as shown in FIG. 28(B); the displacement amount is sharply reduced if the width W is narrowed. The width W of the piezoelectric bodies 90 thus cannot be made small. The dot pitch of the multi-nozzle head, in which a plurality of the nozzles are arranged in a line, i.e. the nozzle spacing d of the piezoelectric head, is determined by the width W of the piezoelectric bodies 90. An ink jet head using such a bimorph structure is thus greatly inferior to a thermal type in terms of the nozzle installation density (the dot pitch) and the cost. For example, the installation density may be 120 dpi for the piezoelectric body bimorph type compared with 600 dpi for the thermal type, a difference of 5 times.

In the case of the piezoelectric body bimorph type, it is thus necessary to make the width W of the piezoelectric bodies 90 narrower, and hence increase the installation density. However, with the piezoelectric body bimorph type, the width W of the piezoelectric bodies 90 determines the displacement amount, and hence if the width W of the piezoelectric bodies is made narrow, then the displacement amount drops sharply, and stress increases There has thus been a problem in that it is not possible to realize the displacement required for ejecting fine ink drops having a volume suitable for printing (e.g. 1 pico-liter or more). Moreover, there has been a problem that if the driving voltage is increased to increase the displacement amount, then the stress increases, and the vibrating plate 91 breaks.

Moreover, a cantilever beam structure for increasing the displacement amount of a piezoelectric body is known (for example, Japanese Patent Application Laid-open No. 2-143861). FIG. 29(A) and FIG. 29(B) are drawings of the constitution of a conventional cantilever beam structure ink jet head. As shown in FIG. 29(A), a vibrating plate 91, a piezoelectric plate 90 and an individual electrode 98 are provided via an ink chamber 95 on a substrate 97 in which a nozzle 92 is formed. As shown in FIG. 29(B), the piezoelectric body 90 and the vibrating plate 91 have a cantilever beam structure in which only one side is supported. With this cantilever beam structure, the three peripheral edges of the bimorph driver 90 other than the one fixed edge are free edges, and hence there is free entry and exiting of ink to and from the pressure chamber 95. There has thus been a problem that the internal pressure in the pressure chamber does not rise to high, and hence ink drops cannot be accelerated to a sufficient speed.

To increase the pressure in the pressure chamber, one can envisage making the gap around the three edges of the bimorph piezoelectric body 90 narrower. For example, the gap suitable for ink flight is 0.5 microns or less. However, it is virtually impossible to align the various layers with high precision and form such a narrow gap around the three edges of the bimorph piezoelectric body 90. There has thus been a problem that, with an easily realizable gap of about a few microns, ink drops fly at only a very low speed.

It is thus an object of the present invention to provide an ink jet head and manufacturing method thereof for obtaining ink drops of sufficient speed even if the width of the piezoelectric bodies is made narrow.

It is another object of the present invention to provide an ink jet head and manufacturing method thereof for narrowing the width of the piezoelectric bodies, and thus increasing the nozzle installation density of the head.

It is a further object of the present invention to provide an ink jet head and manufacturing method thereof for obtaining sufficient displacement and pressure even if the width of the piezoelectric bodies is made narrow.

Furthermore, it is an object of the present invention to provide an ink jet head and manufacturing method thereof for narrowing the width of the piezoelectric bodies, shortening the time required for ink refilling, and increasing the response frequency.

DISCLOSURE OF THE INVENTION

In one form of the head of the present invention, an ink jet head for ejecting ink drops from a nozzle has a pressure chamber that communicates with the nozzle and stores ink, and a bimorph driver that has a piezoelectric body and a vibrating plate and for applying pressure to the pressure chamber, wherein three peripheral sides of the bimorph driver are fixed and the other one side is not fixed.

With this form, because one side of the piezoelectric body of the bimorph driver is made to be free, pressure leakage can be reduced, and tensile stress can be released. Moreover, because three sides are fixed, pressure leakage can be minimized. The displacement and pressure required for ejecting ink drops can thus be obtained even if the width of the piezoelectric body is narrow. A high-density multi-nozzle head can thus be realized.

In another form of the present invention, the bimorph driver has a slit. with this form, one side of the piezoelectric body of the bimorph driver is made to be free using the slit, and hence the gap at the free edge can be made small, and pressure leakage can be minimized. Moreover, because a slit is used, production is easy.

In another form of the present invention, the slit is provided parallel to the long sides of the bimorph driver. With this form, because the slit is parallel to the long sides of the bimorph driver, deterioration in the ink energy conversion efficiency can be prevented even though the slit is provided.

In another form of the present invention, the slit is provided in the center of the bimorph driver. Because the slit is provided in the center of the bimorph driver, deterioration in the energy conversion efficiency can be prevented even though the slit is provided.

In another form of the present invention, the head further has a filling member for blocking up the slit in the bimorph driver. Because the slit is blocked up with a filling member, ink leakage and pressure leakage can be prevented even though the slit is provided.

In another form of the present invention, the head further has an ink tank that communicates with the pressure chamber via the slit. The slit is used as an ink supply channel, and hence refilling with ink is carried out together with ejection of ink, and thus the response frequency rises, and high-speed printing becomes possible.

A multi-nozzle ink jet head of the present invention has a plurality of pressure chambers that each communicates with a nozzle and stores ink, a plurality of bimorph drivers that each has a piezoelectric body and a vibrating plate and that are for applying pressure to the pressure chambers, and an ink tank that communicates with the plurality of pressure chambers, wherein three peripheral sides of each of the bimorph drivers are fixed and the other one side is not fixed.

With this form, because one side of the piezoelectric body of each bimorph driver is made to be free, pressure leakage can be reduced, and tensile stress can be released. Moreover, because three sides are fixed, pressure leakage can be minimized. The displacement and pressure required for ejecting ink drops can thus be obtained even if the width of the piezoelectric bodies is narrow. A high-density multi-nozzle head can thus be realized.

A method of manufacturing a multi-nozzle head of the present invention has a step of forming in order an electrode layer, a piezoelectric body layer and a vibrating plate layer on one face of a substrate, a step of milling each layer on the substrate to form a plurality of separate bimorph drivers each having a slit, a step of etching the other face of the substrate to form separate pressure chambers, and a step of joining a nozzle plate having a plurality of nozzles onto the substrate.

With this form, because the slits are formed at the same time as forming the individual bimorph drivers through milling, bimorph drivers having one free side can be formed easily and cheaply. Since milling is used, slits of very narrow width can be formed, and hence pressure leakage can be minimized.

In another form of the present invention, the manufacturing method further has a step of filling the slits with a filler after forming the plurality of bimorph drivers. Since the slits are filled with a filler, ink leakage and pressure leakage can be prevented even though the slits are provided.

In another form of the present invention, the manufacturing method further has a step of joining an ink supply member having ink supply chambers to the bimorph drivers after forming the plurality of bimorph drivers. The slits are used as ink supply channels, and hence refilling with ink is carried out together with ejection of ink, and thus the response frequency rises, and high-speed printing becomes possible.

BEST MODE FOR CARRYING OUT THE INVENTION

Following are successive descriptions of the bimorph driver, the ink jet head, and the head manufacturing method of the present invention.

Bimorph Driver

Figure 1A:
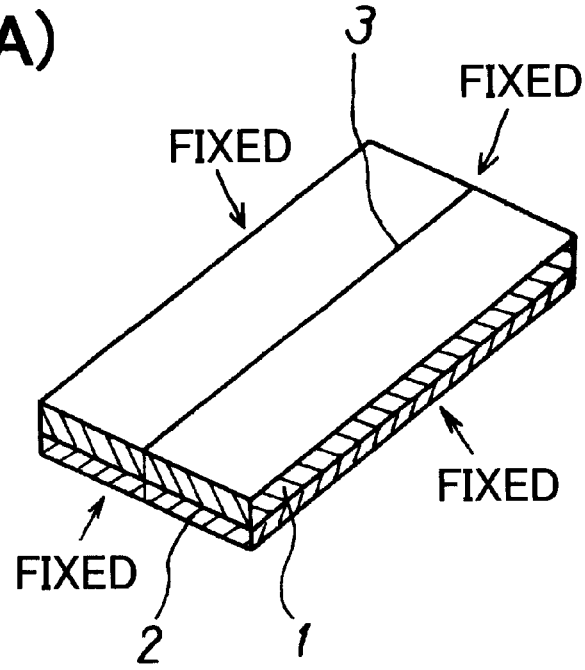
FIGS. 1(A), 1(B) and 1(C) consist of explanatory drawings of a bimorph driver of an embodiment of the present invention.
Figure 1B:
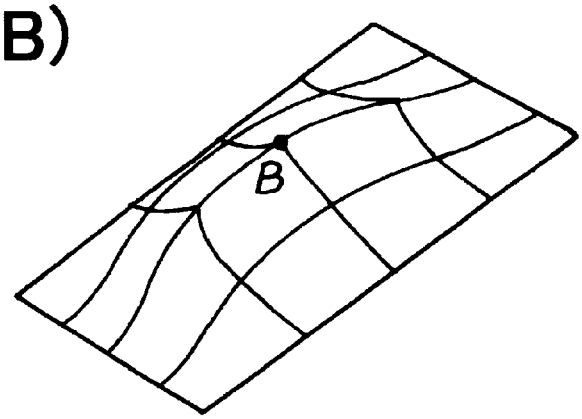
Figure 1C:
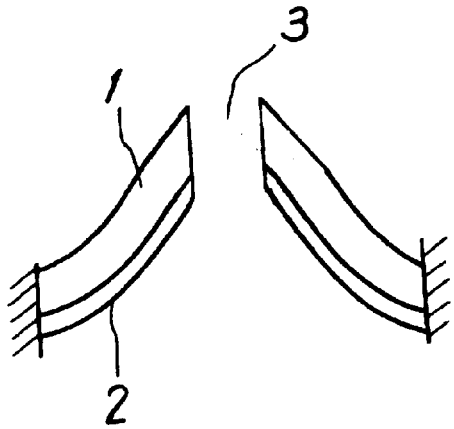
Figure 2A:
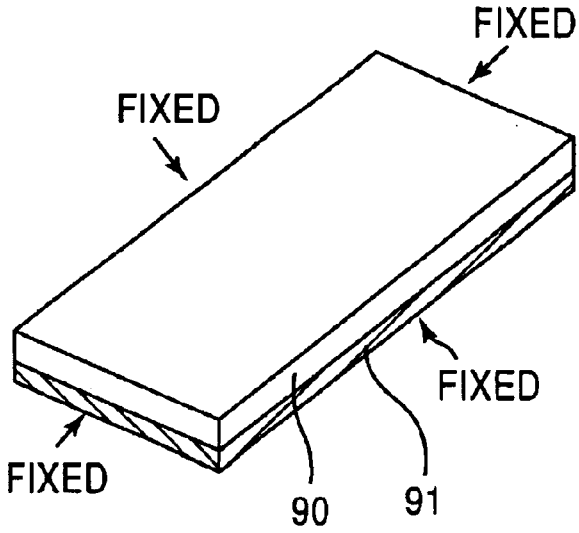
FIG. 2(A) PRIOR ART
FIGS. 2(A), 2(B) and 2(C) consist of explanatory drawings of a conventional bimorph driver for explaining the present invention.
Figure 2B:
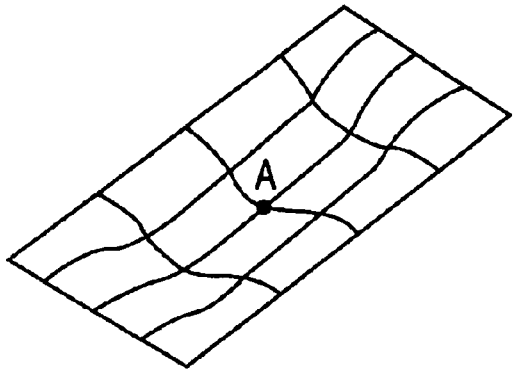
FIG. 2(B) PRIOR ART
Figure 2C:
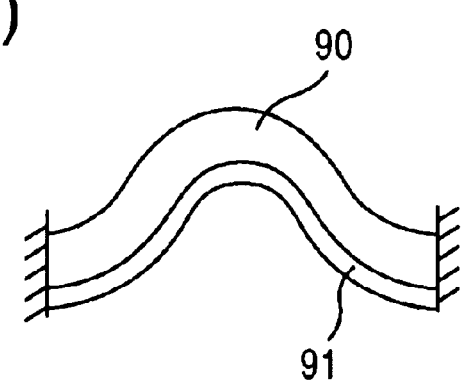
FIG. 2(C) PRIOR ART
Figure 3A:
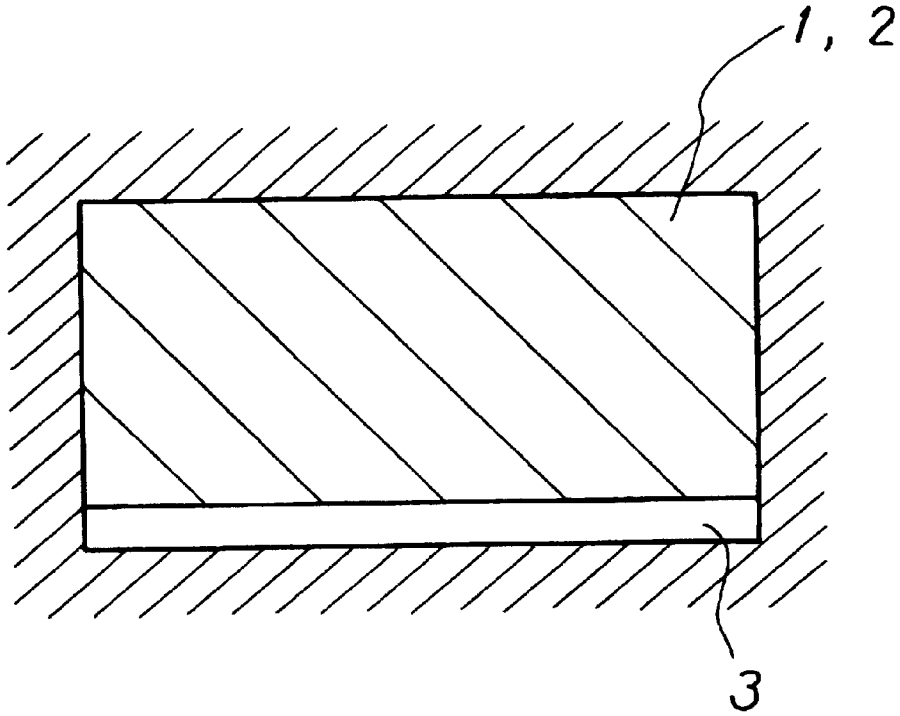
FIGS. 3(A) and 3(B) consist of explanatory drawings of a bimorph driver of another embodiment of the present invention.
Figure 3B:
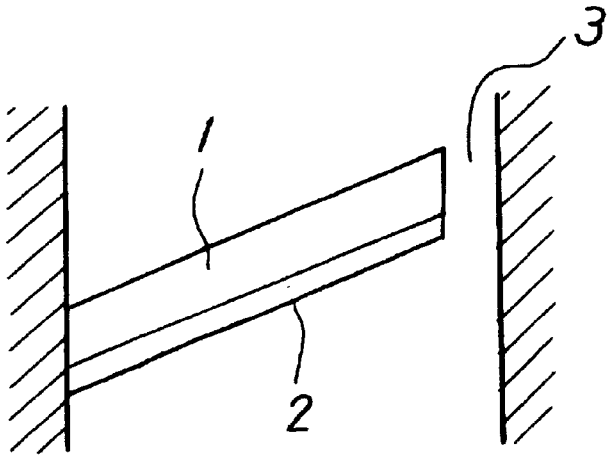

FIGS. 1(A), 1(B) and 1(C) consist of explanatory drawings of the bimorph driver of an embodiment of the present invention, FIGS. 2(A), 2(B) and 2(C) consist of explanatory drawings of a conventional bimorph driver for explaining the present invention, and FIGS. 3(A) and 3(B) consist of explanatory drawings of the bimorph driver of another embodiment of the present invention.

As shown in FIG. 1(A), the bimorph driver comprises a vibrating plate 2 and a piezoelectric body 1 stuck together. The four sides of the vibrating plate 2 and the piezoelectric body 1 are fixed. A slit 3 is provided parallel to the long sides of the bimorph driver so as to divide the bimorph driver in two. The slit 3 may be provided in both the vibrating plate 2 and the piezoelectric plate 1, or may be provided in only the piezoelectric body 1. Three peripheral sides of the bimorph driver are thus fixed, and one side only is a free edge.

FIG. 1(B) is a displacement distribution diagram of the bimorph driver of FIG. 1(A); the displacement is at a maximum at the center of the slit 3 (point B), and the displacement magnification is large. FIG. 1(C) is a sectional view of the bimorph driver of FIG. 1(A); due to being divided by the slit 3, the stress in the piezoelectric body 1 in the vicinity of the slit 3 (the free edge) where displacement is at a maximum is low.

In contrast, the conventional bimorph driver of FIG. 2(A) comprises a vibrating plate 91 and a piezoelectric body 90 stuck together, but a slit is not provided. The four peripheral sides of the bimorph driver are thus fixed. FIG. 2(B) is a displacement distribution diagram for the conventional bimorph driver; the displacement is at a maximum at the center of the face of the piezoelectric body 90 (point A). FIG. 2(C) is a sectional view of the conventional bimorph driver; the stress in the central part of the piezoelectric body 90 where the displacement is at a maximum is large.

That is, as shown in the sectional view of FIG. 2(C), because the periphery of the piezoelectric body 90 of the conventional bimorph driver is fixed, tensile stress arises through displacement, and hence the displacement cannot be made large. Moreover, due to the tensile stress, the stress on the piezoelectric body 90 is large, and hence the piezoelectric body 90 is prone to breaking.

In contrast, with the bimorph driver of the present invention, the tensile stress in the piezoelectric body 1 is released by the slit 3. Consequently, even though both ends are fixed, the displacement of the piezoelectric body 1 becomes large. Moreover, because the tensile stress is released, the stress on the piezoelectric body 1 is low, and hence the piezoelectric body 1 is not prone to breaking.

Even if a high driving voltage is applied to make the displacement amount large, breakage of the bimorph driver can thus be prevented. Moreover, because there is just one slit 3, there is little escape of pressure. The efficiency with which the energy of the bimorph driver is converted into ink ejecting energy is thus high. Even with a small bimorph driver, ink drops can thus be ejected at a sufficient size and speed. Moreover, because there is just one slit 3, manufacturing of the head is also simple.

FIG. 3(A) and FIG. 3(B) area front view and a sectional view of another bimorph structure of the present invention. As shown in FIG. 3(A), a slit 3 is formed at an edge part of the bimorph driver, which comprises a piezoelectric body 1 and a vibrating plate 2. Three peripheral edges of the bimorph driver are thus fixed, and one edge is free.

As shown in FIG. 3(B), one edge of the bimorph drivers 1, 2 is fixed, and another edge part is free, and hence tensile stress in the piezoelectric body 1 is released. The displacement of the piezoelectric body 1 thus becomes large, and the stress on the piezoelectric body 1 is small.

Table 1 shows dimensions of the piezoelectric plate 1 and the vibrating plate 2 suitable for a case in which the nozzle pitch is 600 dpi. For the piezoelectric body 1, PZT is used, the width is 32 $\mu$m, the length is 400 $\mu$m, and the thickness is 0.4 $\mu$m. The density is 8600 kg/m$^3$, the Young's modulus is 100 GPa, and the piezoelectric constant d31 is 100 pm/V. For the vibrating plate 2, on the other hand, Cr is used, the width is 32 $\mu$m, the length is 400 $\mu$m, and the thickness is 0.3 $\mu$m. The density is 7190 kg/m$^3$, and the Young's modulus is 248 GPa.

TABLE 1

| Item | Value |
|---|---|
| Piezoelectric body | |
| Material | PZT |
| Width ($\mu$m) | 32 |
| Length ($\mu$m) | 400 |
| Thickness ($\mu$m) | 0.4 |
| Density (kg/m$^3$) | 8600 |
| Young's modulus (GPa) | 100 |
| Piezoelectric constant d31 (pm/V) | 100 |
| Vibrating plate | |
| Material | Cr |
| Width ($\mu$m) | 32 |
| Length ($\mu$m) | 400 |
| Thickness ($\mu$m) | 0.3 |
| Density (kg/m$^3$) | 7190 |
| Young's modulus (GPa) | 248 |

The displacement amount, the volumetric displacement for the whole face, the generated pressure, and the maximum stress in the vibrating plate are shown in Table 2 for the bimorph structure of the present invention of FIG. 1(A) and the conventional bimorph structure of FIG. 2(A) having the above dimensions.

TABLE 2

| Item | Conventional | Present invention (slit: central part) |
|---|---|---|
| Applied Voltage (V) | 9.0 (3.7) | 9.0 |
| Displacement amount (nm) | 342 (141) | 613 |
| Volumetric displacement (pl) | 2.30 (0.95) | 2.62 |
| Generated pressure (MPa) | 0.34 (0.14) | 0.267 |
| Stress (MPa) | 1230 (500) | 500 |

As shown in Table 2, when the applied voltage is 9V, for the conventional bimorph structure, the Von Mises stress in the vibrating plate becomes 1.2 GPa, and the vibrating plate breaks. If the stress in the vibrating plate is limited to 500 MPa (i.e. the driving voltage is reduced to 3.7V) to avoid this breakage, then as shown by the figures in the brackets in Table 2, the volumetric displacement becomes 0.95 pl, and the generated pressure becomes 0.14 MPa. It can thus be seen that it is not possible to eject ink drops of 1 pico-liter or above suitable for printing.

In contrast, for the bimorph structure of the present invention, when the applied voltage is 9V, the stress in the vibrating plate is 500 MPa, and the vibrating plate does not break. When the slit position is the center, the displacement amount is 613 nm, the volumetric displacement is 2.62 pl, and the generated pressure is 0.267 MPa; fine ink drops of about 2 to 3 pico-liters, which is the optimum for high-resolution printing, can thus be ejected.

It can be seen from the above that, within the breaking limit, the bimorph driving source of the present invention has a displacement amount of 4.3 times, a volumetric displacement of 2.8 times, and a generated pressure of 1.9 times that of the conventional driving source; the problem of the conventional bimorph structure of the displacement amount being insufficient when the driver is made to be narrow can thus be overcome.

Fine ink drops of about 2 to 3 pico-liters, which is the optimum for high-resolution printing, can thus be ejected at a nozzle pitch of 600 dpi, and moreover a nozzle pitch exceeding 600 dpi can be realized.

The position of the slit 3 can be freely chosen within a range from the edge part of the driver (close to the pressure chamber wall) to the central part of the driver. The effects obtained through the slit are related to the position of the slit 3 relative to the bimorph driver.

In the case that the slit 3 is provided in the center of the bimorph driver as shown in FIG. 1(A), driving is carried out from both sides of the slit 3, and hence the stress in the vicinity of the slit of the bimorph driver is low. The driving voltage can thus be made high. Moreover, the shape is such that one bimorph driver is divided into two bimorph drivers, and hence the width is reduced, and thus the displacement is relatively small, and the generated pressure is relatively large.

In contrast, in the case that the slit 3 is in an edge part of the bimorph driver as shown in FIG. 3(A), driving is only carried out from one side of the slit, and hence the stress in the vicinity of the slit of the bimorph driver is large. Moreover, because there is just one wide bimorph driver, the displacement is relatively large, and the generated pressure is relatively small.

With the bimorph structure shown in FIG. 1(A), a large displacement amount can thus be obtained by making the driving voltage high. Moreover, with the bimorph structure shown in FIG. 3(A), a large displacement amount can be obtained, and hence usage is possible with the width of the piezoelectric body further reduced (for example, 15 $\mu$m) and the stress reduced. Since the width of the piezoelectric body can be made smaller, a head with a narrower dot pitch can be realized. This is suitable for a head with an installation density of 1200 dpi or more.

Next, the shape of bimorph driver suitable in the present invention will be considered. A suitable shape for the bimorph driver is a strip shape with a narrow width (for example, 32.5 $\mu$m) and a long length (for example, 400 $\mu$m). When the width is narrow, then the nozzle spacing can be made small, and hence the installation density can be increased. Moreover, when the nozzle density is high, then the manufacturing cost of the multi-nozzle head can be reduced.

Furthermore, when the shape is such a strip shape, then compared with a square bimorph driver of the same area, the thickness of the piezoelectric body 1 for producing the same volumetric displacement and generated pressure can be reduced, and moreover the driving voltage is lower. The volume of the piezoelectric body can thus be made small, and hence the manufacturing cost can be reduced. Furthermore, because the driving voltage can be made low, the cost of the driving circuitry can also be reduced.

In this way, with a bimorph structure having a narrow width and a long length, a high pressure and a large volume change can be obtained with a thin piezoelectric body; the effects thus differ according to the direction of the slit 3, i.e. the best performance is exhibited when the slit 3 is parallel to the long sides of the rectangular bimorph structure and is positioned in the center between the long sides.

For example, in the case that the slit is provided parallel to the short sides of the rectangular bimorph structure, the extent of release of stress in the width direction of the piezoelectric body will be low, and hence the generated pressure will drop. Moreover, in the case that the slit is provided diagonally across the rectangular bimorph structure, torsion will be produced in the ink in the pressure chamber, and hence the energy for ink ejection will be wasted. Moreover, escape of pressure from the pressure chamber will also be high. The energy efficiency, which is defined as the ratio of the mechanical output energy of the bimorph driver (volumetric displacement x generated pressure) to the electrostatic energy put into the bimorph driver, is at a maximum when the slit 3 is parallel to the long sides.

Furthermore, in the case that the slit is parallel to the long sides of the rectangular bimorph structure but is not positioned in the center between the long sides, the displacement amount will be different on each side of the slit, and hence torsion will be produced in the ink in the slit, and thus energy will be wasted.

From the above, to minimize ink flow in the slit part and increase the energy efficiency of ink ejection, the best performance is exhibited when the slit 3 is parallel to the long sides of the rectangular bimorph structure and moreover is positioned in the center between the long sides.

In terms of processing precision, it is hard to satisfy the conditions of the slit being perfectly in the middle and parallel, i.e. there are limitations in terms of processing precision. The optimum performance can thus be obtained provided the slit is positioned approximately in the center and is approximately parallel.

It is preferable for the width of the slit to be as narrow as possible from the standpoint of being able to prevent pressure leakage, but again there are limitations in terms of processing precision. For example, in the present embodiment, about 0.5 microns is suitable. Moreover, from the viewpoint of releasing the tensile stress in the piezoelectric body, it is necessary to provide the slit in at least the piezoelectric body. Because the vibrating plate is integrated with the piezoelectric body, by also forming the slit in the vibrating plate, the tensile stress can be released even better.

In addition to PZT as mentioned above, other piezoelectric materials can be used as the piezoelectric body. Moreover, in addition to Cr as mentioned above, other non-piezoelectric materials can be used as the vibrating plate.

Structure of Ink Jet Head

Figure 4A:
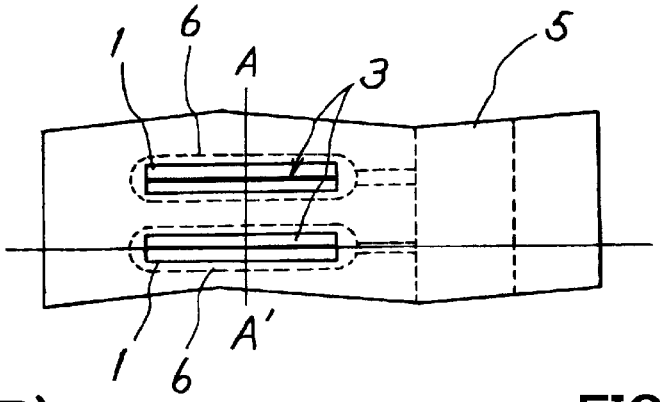
FIGS. 4(A), 4(B) and 4(C) consist of drawings of the constitution of an ink jet head of a first embodiment of the present invention.
Figure 4B:
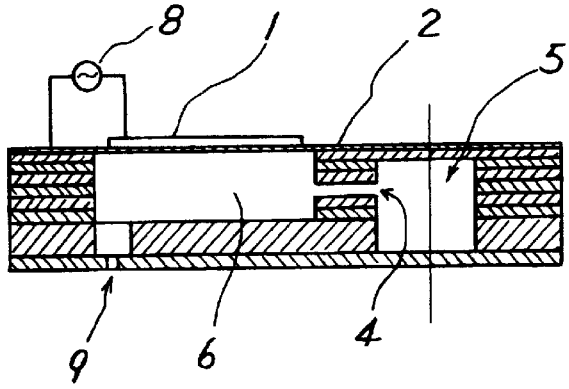
Figure 4C:
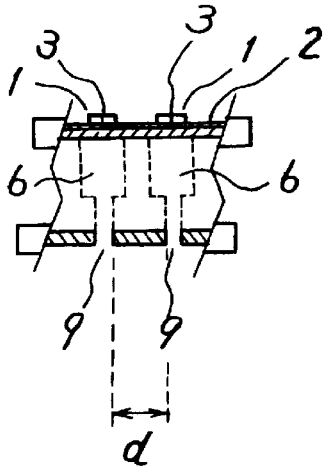
Figure 5:
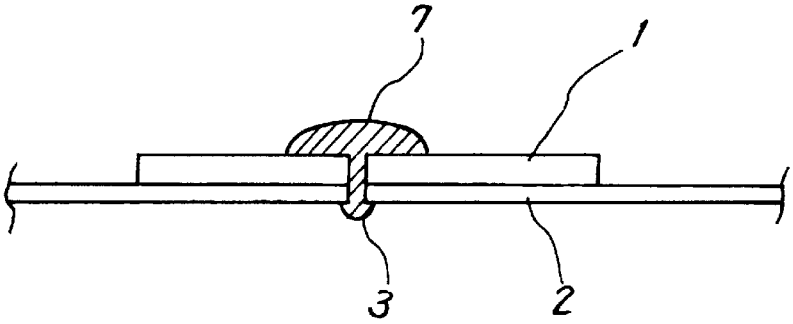
FIG. 5 is an enlarged view of part of the head of FIG. 4.
Figure 6:
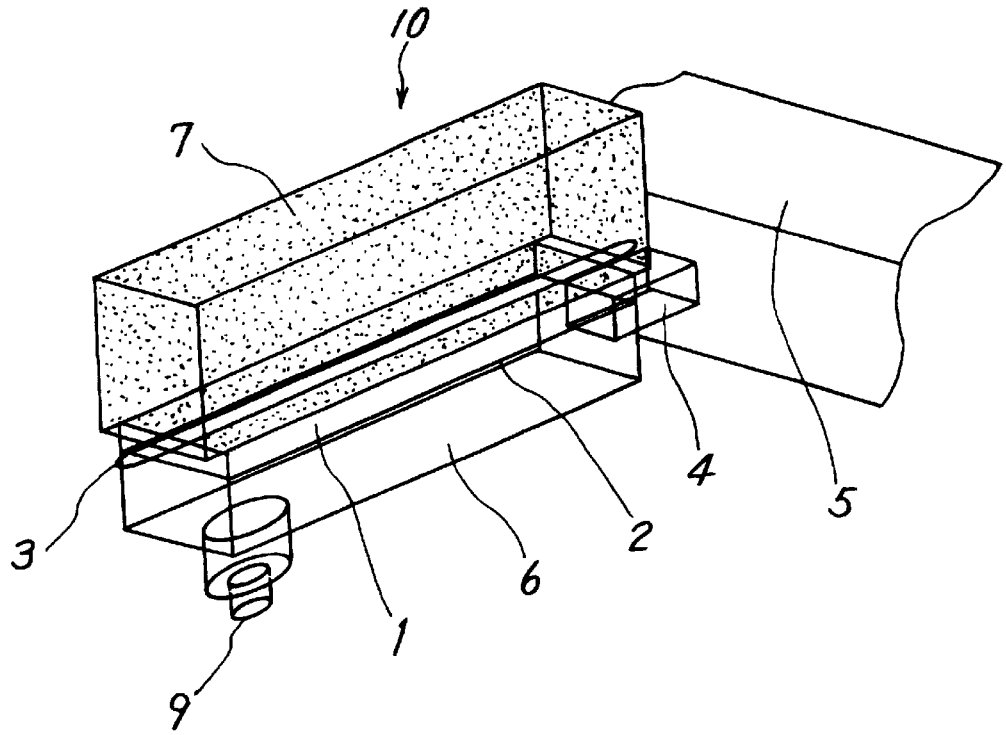
FIG. 6 is a perspective view of the head unit of FIG. 4.
Figure 7:
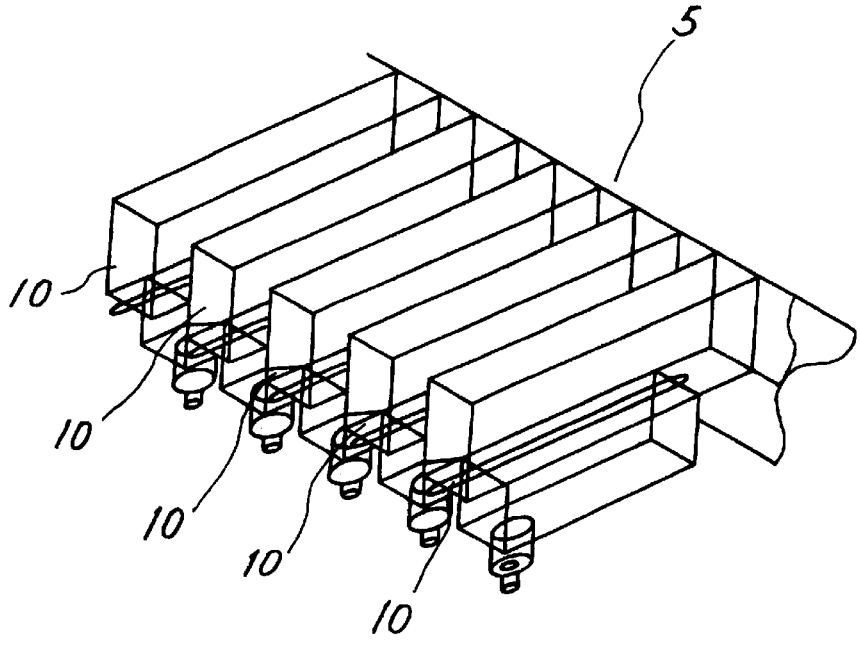
FIG. 7 is a perspective view of part of the multi-nozzle head of FIG. 4.
Figure 8:
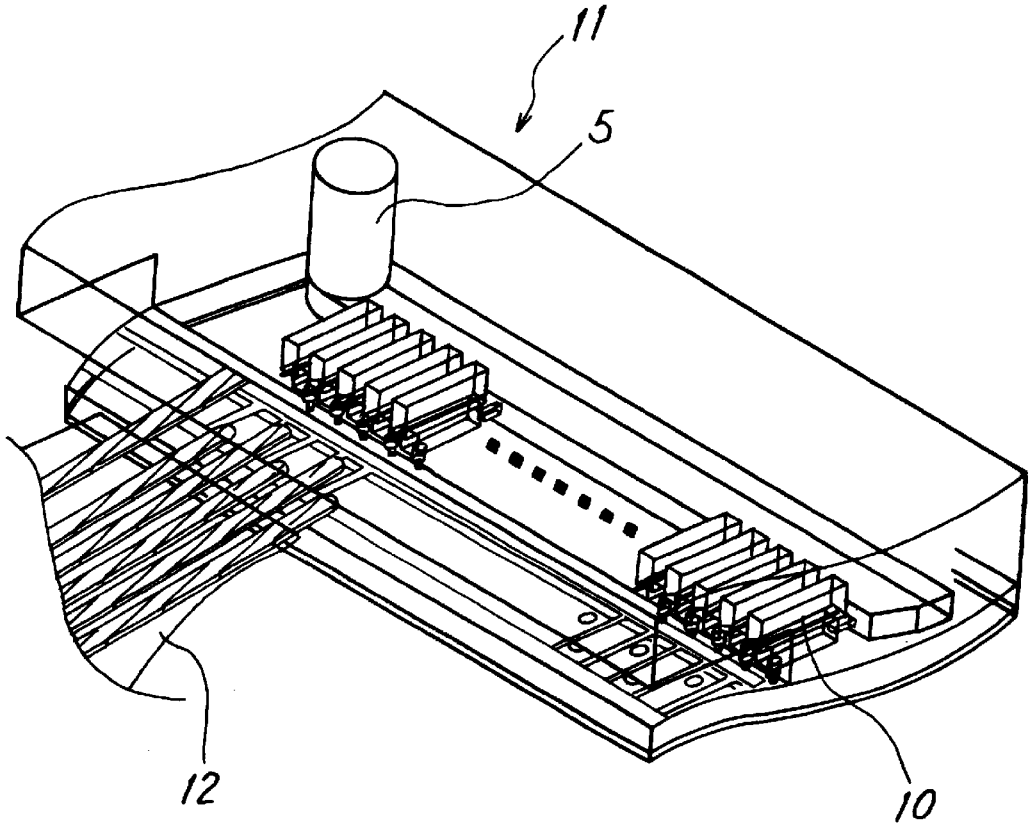
FIG. 8 is a perspective view of the multi-nozzle head of FIG. 4.
Figure 9:
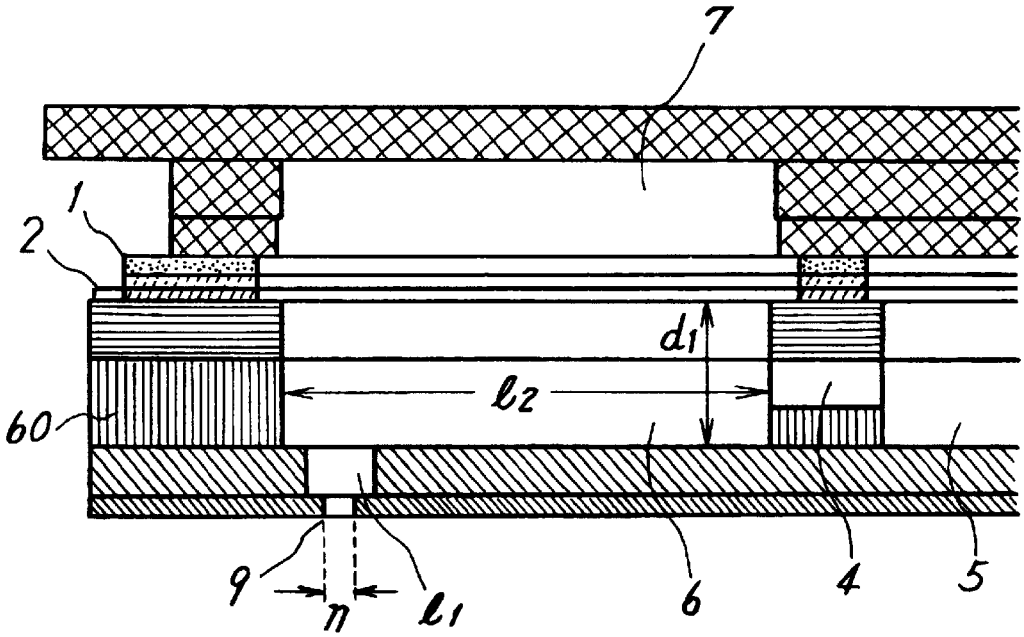
FIG. 9 is a detailed sectional view of the multi-nozzle head of FIG. 4.

FIGS. 4(A) 4(B) and 4(C) consist of drawings of the constitution of the ink jet head of a first embodiment of the present invention, FIG. 5 is an enlarged view of part thereof, FIG. 6 is a perspective view of the head unit, FIG. 7 is a perspective view of part of the multi-nozzle head, FIG. 8 is a perspective view of the whole thereof, and FIG. 9 is a sectional enlarged view thereof.

FIG. 4(A) is a top view of the multi-nozzle head, FIG. 4(B) is a sectional view thereof, and FIG. 4(C) is a front view thereof.

As shown in FIG. 4(A), FIG. 4(B) and FIG. 4(C), pressure chambers 6 are formed under a vibrating plate 2. A nozzle 9 is provided in each pressure chamber 6. Each pressure chamber 6 communicates with a common ink chamber 5 via an ink supply channel 4. Rectangular piezoelectric plates 1 corresponding to the pressure chambers 6 are provided on the vibrating plate 2. Slits 3 are provided in the piezoelectric plates 1 and the vibrating plate 2, positioned in the center in the width direction of each piezoelectric plate 1 and running parallel to the long sides of the rectangular shape.

As shown in FIG. 5, the slits 3 in the piezoelectric bodies 1 and the vibrating p late 2 are blocked up with a filling member 7. This filling member 7 prevents leakage of ink from the slit 3, and also prevents escape of pressure from the pressure chamber 6. The filling member 7 is preferably elastic, so that the flexing movement of the piezoelectric plate 1 will not be impeded. Silicone rubber, for example, is suitable as the filling member 7.

As shown in FIG. 4(B), individual electrodes (not shown) are formed on the piezoelectric bodies 1. The vibrating plate 2 functions as a common electrode. A power source 8 is connected between the vibrating plate 2 and the individual electrode of each piezoelectric plate 1, and a driving voltage is supplied by the power source 8. When the driving voltage is applied to the piezoelectric plate 1, the bimorph driver comprising the vibrating plate 2 and the piezoelectric plate 1 flexes toward the pressure chamber 6 side. The pressure in the pressure chamber thus rises, and hence ink is ejected from the nozzle 9, and at the same time ink flows out into the common ink channel 5 via the supply hole 4. The pressure inside of the pressure chamber 6 thus becomes a negative pressure, and hence the meniscus at the nozzle 9 moves to the pressure chamber side, and at the same time ink is refilled from the common channel 5 via the supply hole 4.

In this embodiment, the bimorph driver shown in FIG. 1 is used, and hence as mentioned above, even if the width of the piezoelectric body 1 is made narrow, a large displacement amount can be obtained, and ejection of 2- to 3-picoliter ink drops can be carried out. It is thus possible, for example, to set the width of the piezoelectric bodies 1 at 32 $\mu$m, and set the nozzle spacing d shown in FIG. 4(C) at 600 dpi or more.

In this embodiment, by inserting a slit parallel to one side of the rectangular bimorph structure, the displacement magnification becomes large, and stress is relaxed, and hence a high nozzle installation density can be realized. Moreover, because there is just one slit, processing is simple. The opening produced by inserting the slit in the bimorph structure is blocked up with another member, and hence application to a conventional ink jet head can be carried out easily, and moreover conventional ink jet head design technology can be used.

Next, a description will be given of embodiments.

FIG. 8 is a perspective view of a multi-nozzle ink jet head. The constitution of the multi-nozzle head 11 is such that 256 head units 10 are provided in a line in a common ink chamber 5. A flexible cable 12 is provided to connect the head units 10 to the outside.

As shown in FIG. 6, the head units 10 have the same constitution as in FIG. 4. That is, the respective pressure chambers 6 are provided under a vibrating plate 2. A nozzle 9 is provided in each pressure chamber 6. Each pressure chamber 6 communicates with a common ink chamber 5 via an ink supply channel 4. Rectangular piezoelectric plates 1 corresponding to the pressure chambers 6 are provided on the vibrating plate 2. Slits 3 are provided in the piezoelectric plates 1 and the vibrating plate 2, positioned in the center in the width direction of each piezoelectric plate 1 and running parallel to the long sides of the rectangular shape. The slits 3 of the piezoelectric bodies 1 and the vibrating plate 2 are blocked up with elastic members 7. FIG. 7 is a drawing showing the continuous arrangement of the head units.

The nozzle pitch in the present embodiment, i.e. the spacing between the head units, is 600 dpi. In addition to a normal water-soluble ink, an oil-based ink or a solid ink can be used as the ink. Regarding the width of the slits 3, if it is wide then manufacturing is easy, but if it is too wide then pressure escape due to flexing of the member 7 blocking up the slits 3 will become large, and the applied voltage will rise, and also the natural frequency related to the ink ejection (the Helmholtz frequency) and the response frequency of the head will drop. In the present embodiment, the slit width is thus made to be 0.5 microns.

FIG. 9 is a detailed sectional view of the head for explaining the dimensions of the printing head. Table 3 shows the printing head dimensions and the ink ejection performance.

TABLE 3

| Item | Value |
|---|---|
| Nozzle bore (μm) | 10 |
| Nozzle length (μm) | 12 |
| Pressure chamber width (μm) | 32.5 |
| Pressure chamber length (μm) | 400 |
| Pressure chamber depth (μm) | 70 |
| Pressure chamber thickness (μm) | 6.83 |
| Pressure chamber material | Ni |
| Young's modulus of pressure chamber (GPa) | 219 |
| Piezo width (μm) | 32.5 |
| Slit width (μm) | 0.5 |
| Piezo thickness (μm) | 0.4 |
| Vibrating plate thickness (μm) | 0.3 |
| Supply hole width (μm) | 8 |
| Supply hole depth (μm) | 8 |
| Supply hole length (μm) | 12 |
| Applied voltage (V) | 9.0 |
| Particle volume (pl) | 2.0 |
| Particle flying speed (m/s) | 8.0 |

As shown in FIG. 9 and Table 3, the bore n of the nozzles 9 was made to be 10 μm, and the length 11 12 μm. The width of the pressure chambers 6 was made to be 32.5 μm, the length 12 400 μm, and the depth d1 70 μm. The thickness of the pressure chamber walls between the pressure chambers 6 shown in FIG. 4(C) was made to be 6.83 μm. The material of the walls 60 constituting the pressure chambers 6 was made to be Ni, and the Young's modulus of the pressure chambers was made to be 219 GPa. The width W of the piezoelectric bodies ('piezos') 1 was made to be 32.5 μm, and the thickness 0.4 μm. The width of the slits 3 was 0.5 μm. The thickness of the vibrating plate 2 was 0.3 μm, and the width, depth and length of the supply holes 4 were 8 μm, 8 μm and 12 μm respectively. The materials of the vibrating plate 2 and the piezoelectric bodies 1 were made to be Cr and PZT, as in Table 1.

Silicone rubber was used as the filler 7 of the slits 3, with the Young's modulus thereof being 5.9 MPa. A water-based dye ink was used as the ink, with the viscosity thereof being 2.5 cP, the surface tension 0.030N/m, the speed of sound 1550 m/s, and the density 1024 kg/m$^3$.

As shown in Table 3, as a result of adding an applied voltage of 9V to this head, ink drops were ejected with a particle volume of 2.0 pl at a particle flying speed of 8.0 m/s. In this way, even if the width of the piezoelectric bodies 1 is made to be narrow, for example about 30 μm, ink drops of sufficient volume can be obtained at sufficient speed. Even if the width of the piezoelectric bodies 1 is made to be narrow and the installation density of the head is made to be high, high-resolution ink jet recording is thus possible.

Figure 10:
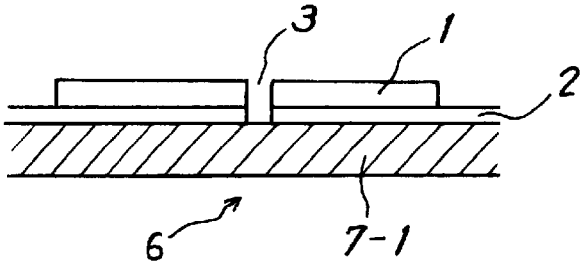
FIG. 10 is an enlarged view of part of an ink jet head of a second embodiment of the present invention.

FIG. 10 is an enlarged view of a head of a second embodiment of the present invention. To block up the slits 3 in the piezoelectric bodies 1 and the vibrating plate 2, a macromolecular film 7-1 is provided on the pressure chamber 6 side. The macromolecular film 7-1 is thermally fused to the vibrating plate 2. A PET film is suitable as the macromolecular film 7-1. The thickness of the film 7-1 is 5 μm, and the Young's modulus is 4 GPa. When this film was applied to the head shown in Table 3, ink of physical properties used with the head of FIG. 9 was used, and the ink ejection performance was investigated, whereby results similar to those of Table 3 were obtained.

Figure 11:
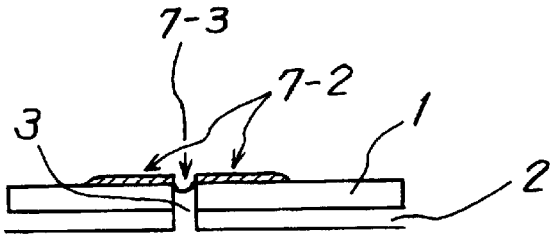
FIG. 11 is an enlarged view of part of an ink jet head of a third embodiment of the present invention.

FIG. 11 is an enlarged view of a head of a third embodiment of the present invention. In this embodiment, by making the slits 3 be hydrophilic and providing a water-repellant film 7-2 at an end part of each slit 3, a strong meniscus 7-3 is formed through the surface tension of the ink inside the slit 3, which is extremely narrow, and hence leakage of ink and escape of pressure are prevented. The water-repellant film 7-2 can be formed, for example, by burning on a liquid resin such as a fluorine-containing resin.

In the present embodiment, from the dimensions of the printing head shown in Table 3, the width of the slits 3 was made to be 0.2 μm. Moreover, by setting the contact angle of the water-repellant part of the water-repellant film 7-2 at 70°, setting the contact angle of the hydrophilic part at 10°, and using ink of surface tension 0.030N/m, a meniscus pressure of 0.59 MPa sufficient to prevent escape of pressure from the pressure chambers was obtained. When an applied voltage of 9V was applied to this head, ink drops were ejected with a particle volume of 1.8 pl and a particle flying speed of 7.5 m/s.

Method of Manufacturing Ink Jet Head

As described above, the piezoelectric bodies 1 of the present head are extremely thin at about 0.4 μm, and hence it is suitable to form them by a sputtering method. Following is a description of the method of manufacturing the head.

FIGS. 12 to 15 show the manufacturing process of the first head of FIGS. 4 to 10.

Figure 12A:
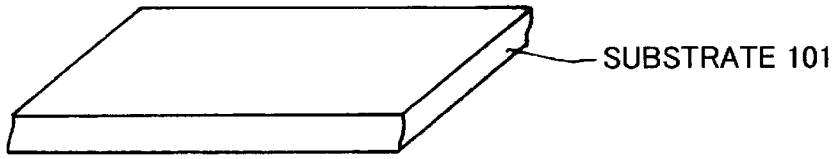
FIGS. 12(A), 12(B), 12(C), 12(D) and 12(E) consist of first explanatory drawings of a manufacturing process of the ink jet head of the first embodiment of the present invention.

As shown in FIG. 12(A), a substrate 101 is prepared. A magnesium oxide (MgO) mono-crystal of thickness 0.03 mm is used as the substrate 101. This can be obtained, for example, by fixing a thick substrate of thickness about 300 to 500 μm on a wafer of Si(Silicon) or the like, and making the substrate thinner by polishing or the like. Moreover, the thin substrate may also be obtained by whole surface etching.

Figure 12B:
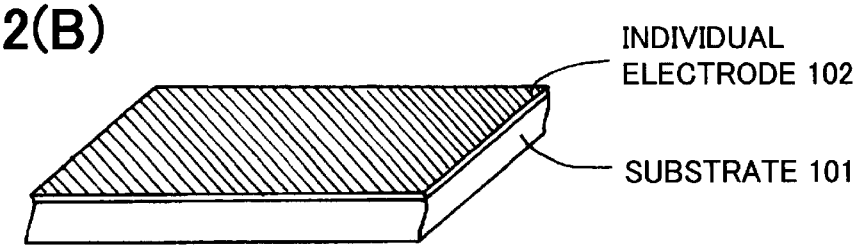
Figure 12C:
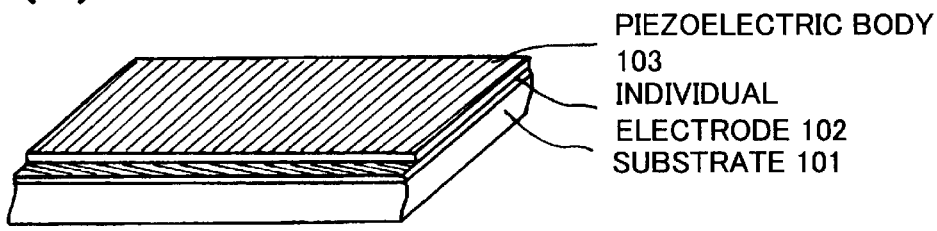
Figure 12D:
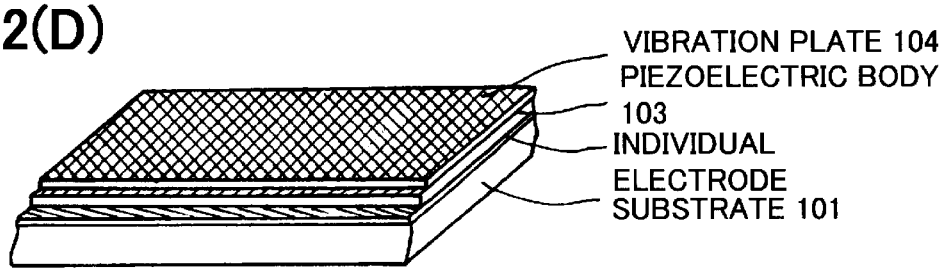

Next, as shown in FIG. 12(B), an electrode layer (individual electrodes) 102 is formed on the substrate 101. Then, as shown in FIG. 12(C), a piezoelectric body layer 103 is formed on the electrode layer 102. Furthermore, as shown in FIG. 12(D), a vibrating plate 104 is formed on the piezoelectric body layer 103. All of these are formed using a sputtering method, which is a thin film formation technique. In the present embodiment, platinum (Pt) is used as the material of the electrode layer 102, and Cr is used as the material of the vibrating plate 104. Here, to expose the individual electrode layer at the edges, and to form a margin for the piezoelectric body layer 103, and furthermore to prevent shorting with the common electrode (vibrating plates) 104, the layers are formed in a stepped fashion.

Figure 12E:
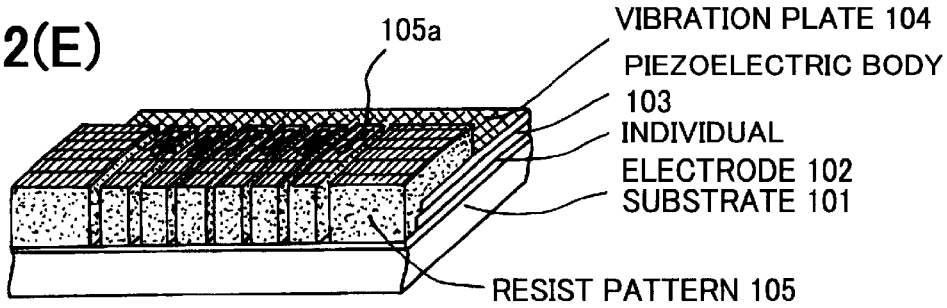

Next, as shown in FIG. 12(E), a milling pattern for dividing the above laminate into parts corresponding to the pressure chambers and forming the slits in the vibrating plates and the piezoelectric bodies is formed using a dry film resist (hereinafter referred to as 'resist pattern') 105. FIG. 12(E) shows the state after the resist pattern 105, which includes slit parts 105*a*, has been formed; the resist pattern 105 is formed in places where the above-mentioned electrode layer 102, piezoelectric body layer 103 and vibrating plate 104 are to be left behind. In the present embodiment, FR130 (made by Tokyo Ohka Kogyo Co., Ltd.: alkali type resist, thickness 30 μm) was used as the resist pattern, laminating was carried out at 2.5 kgf/cm, 0.5 m/s and 115°

C., and then 120 mJ exposure was carried out with a glass mask. Next, preliminary heating at 60° C. for 10 minutes and then cooling to room temperature were carried out, and then developing was carried out with a 1 wt % $Na_2CO_3$ solution, thus forming the pattern.

Figure 13A:
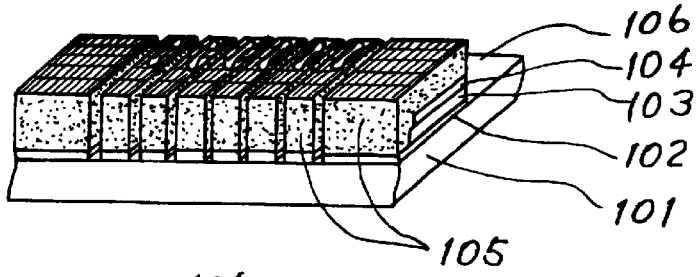
FIGS. 13(A), 13(B), 13(C), 13(D) and 13(E) consist of second explanatory drawings of the manufacturing process of the ink jet head of the first embodiment of the present invention.

Next, as shown in FIG. 13(A), this substrate was fixed to a copper holder using grease having good thermal conductivity, and milling was carried out at 700V using Ar(Argon) gas only with an irradiation angle of −5°. As a result, the shape became as shown in FIG. 13(A), and the taper angle in the depth direction of the milled parts became perpendicular at an angle of 85° or more relative to the surface. The state after removal of the resist pattern 105 is shown in FIG. 13(B).

Figure 13B:
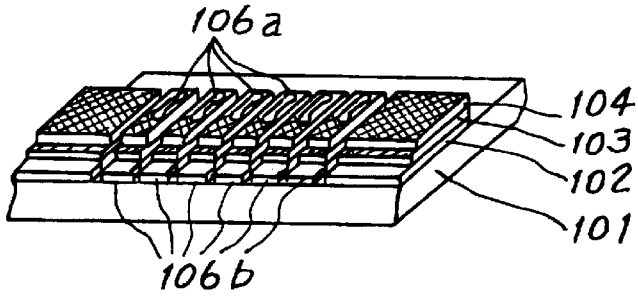

As shown in FIG. 13(B), a plurality of separate bimorph drivers 106*b* are formed on the substrate 101. Each of the individual bimorph drivers 106*b* is formed from an individual electrode 102, a piezoelectric body 103 and a common electrode (vibrating plate) 104 laminated together. Moreover, a slit 106*a* is formed in the center of each of the bimorph drivers 106*b*.

Figure 13C:
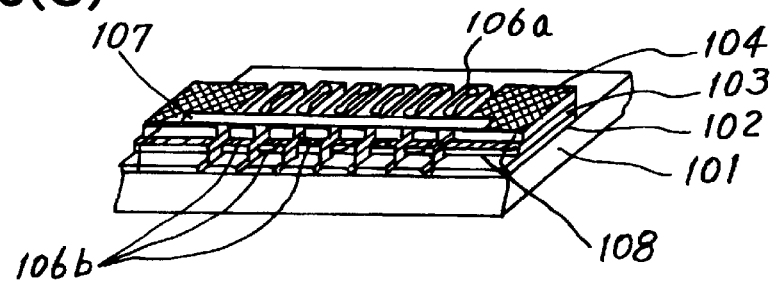

Next, as shown in FIG. 13(C), the divided vibrating plates 104 are electrically connected to one another by an electrode 107, thus making the vibrating plates 104 into a common electrode. To form the electrical connection parts of the individual electrodes 102, an insulating layer 108 is then formed on the above-mentioned stepped parts. In the present embodiment, a photosensitive polyimide was used as the insulating layer 108. Contact holes were formed in the parts of the insulating layer 108 corresponding to the individual electrodes.

Figure 13D:
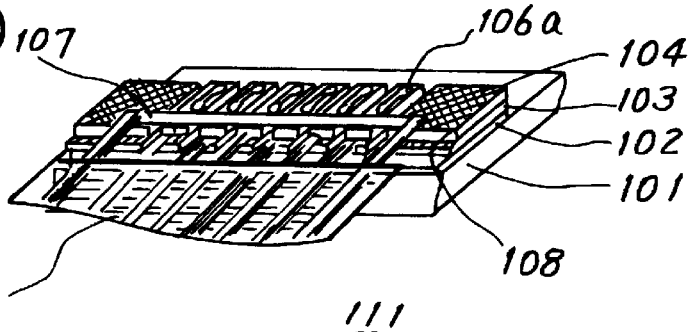

Next, as shown in FIG. 13(D), to connect the above-mentioned individual electrodes 102 and the vibrating plates (common electrode) 104 to the outside, an FPC (flexible cable) 109 is connected to the individual electrodes 102 and the vibrating plates (common electrode) 104. At this time, a contact is formed on each of the individual electrodes 102 by placing gold (Au) balls on each of the contact holes in the insulating layer 108 or carrying out plating, and connection to the end of the FPC 109 is carried out all at once.

Figure 13E:
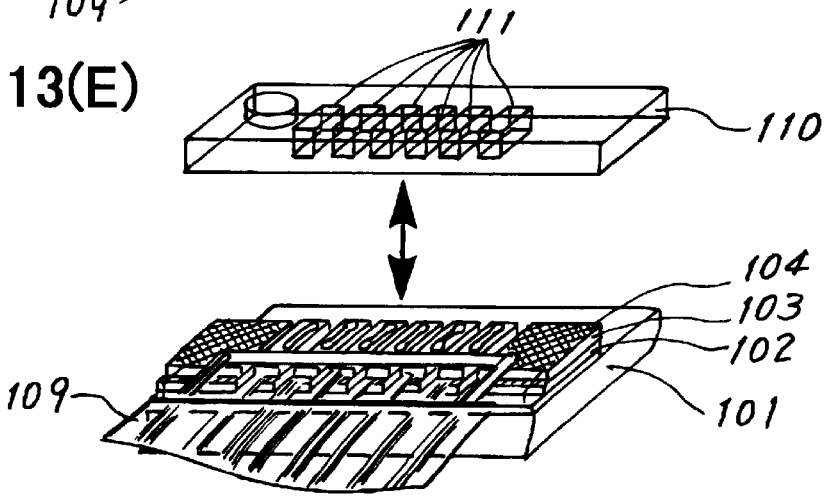

Next, as shown in FIG. 13(E), to fill a filler into the slit 106*a* of each of the bimorph drivers 106*b*, a filler supply member 110 having openings 111 corresponding to the slits 106*a* is prepared. The openings 111 of the filler supply member 110 are very small, and are thus formed by electroforming or the like. Alignment is carried out such that the openings 111 are positioned over the slits 106*a* of the bimorph drivers 106*b*, and the filler supply member 110 is bonded to the vibrating plates 104.

Figure 14A:
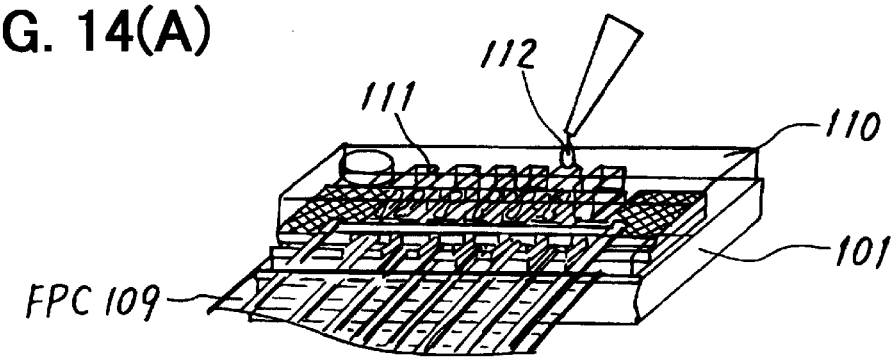
FIGS. 14(A), 14(B), 14(C) and 14(D) consists of third explanatory drawings of the manufacturing process of the ink jet head of the first embodiment of the present invention.

Next, as shown in FIG. 14(A), an elastic member (filler) 112 is injected into each of the openings 111 in the filler supply member 110, and hardening is carried out by heating. In the present embodiment, TES 3320 (made by Toshiba Silicones) was used as the elastic members 112. The elastic members 112 were injected, and thermal hardening was carried out at 100° C. for 1 hour. At this time, to prevent the filled elastic members 112 from sticking to the upper surface of the filler supply member 110 or overflowing, injection is carried out such that the elastic members 112 are thinner than the depth of the member 110. In this way, the slits 3 are filled with the filler 112 as shown in FIG. 6.

Figure 14B:
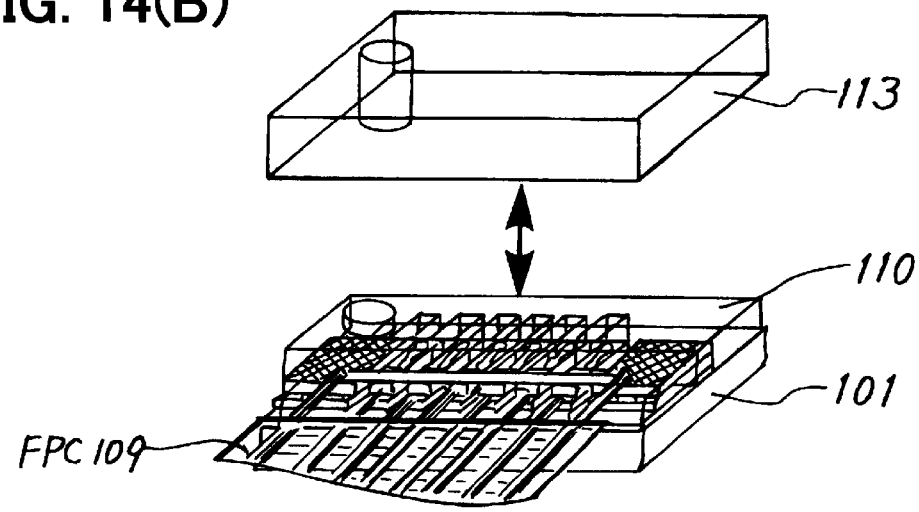

Next, as shown in FIG. 14(B), a lid member 113 is joined to the upper surface of the filler supply member 110 using an adhesive. A glass-fiber-added member was used as the lid member 113. Moreover, it is not a problem even if air bubbles remain in the openings 111 after the elastic members 112 have been injected in. After the joining and fixing, adhesive/fixative is injected into the space between the connecting part of the FPC 109 and the lid member 113, thus strengthening the electrical contacts and the whole. In the present embodiment, a heat-resistant curing resin (Ablebond 342-3) was used. Another filler or curing resin may be used, so long as it is heat-resistant.

Figure 14C:
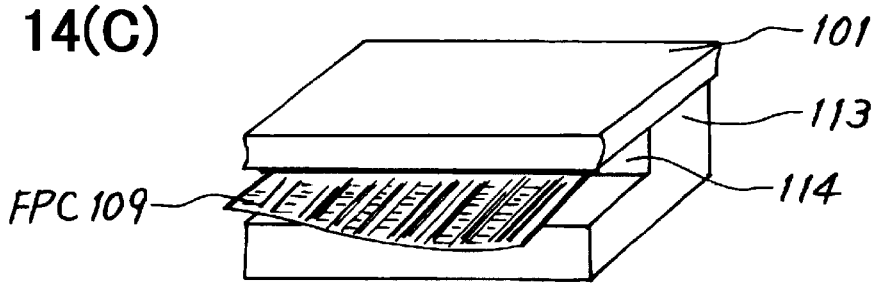

As shown in FIG. 14(C), filler 114 is filled into the joining part of the FPC 109 in this way, thus filling up the gap between the joining part of the FPC 109 and the lid member 113, and securing a strength sufficient for withstanding joining in a subsequent step, and then the whole is turned over, thus making the surface of the substrate 101 the top side.

Figure 14D:
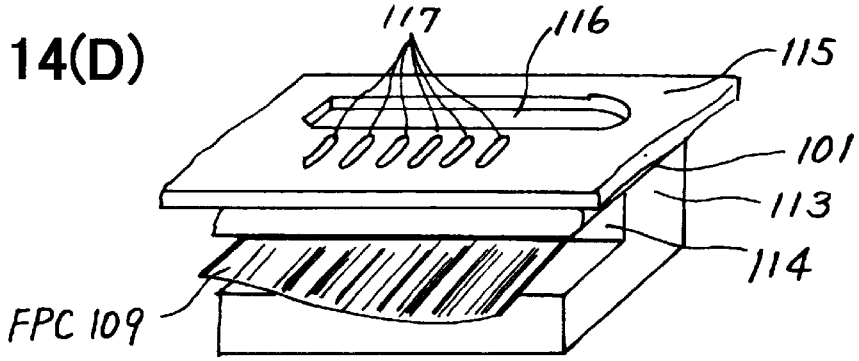

Next, as shown in FIG. 14(D), an etching pattern mask 115 for forming the pressure chambers is bonded to a piezoelectric body modified part of the substrate 101. This etching pattern mask 115 has pressure chamber parts 117 and an ink channel part 116. The etching pattern mask 115 used in the present embodiment was REVAALPHA made by Nitto Denko Corporation. In the milling carried out to form the above-mentioned divided bimorph drivers 106*b*, alignment marks (not shown) were formed at the same time. The alignment between the etching pattern mask 115 and the substrate 101 is carried out using these alignment marks. Since the substrate 101, which is an MgO substrate, is a transparent body, the alignment can be carried out easily. Moreover, the etching pattern mask 115 has a large area, so that during etching of the substrate 101, the etching liquid will not come into contact with the FPC 109 or the bimorph drivers 106*b*.

Next, etching was carried out by immersing for 40 minutes using an 80° C. 80% phosphoric acid solution. After this, washing with water and drying were carried out, then the head was put onto a 170° C. hotplate such that the etching pattern mask 115 surface came into contact with the hot plate, and the mask 115 only was peeled off. As shown by the head after the peeling off in FIG. 15(A), separate pressure chambers 101*b* and an ink channel 101*a* were formed in the substrate 101.

Figure 15A:
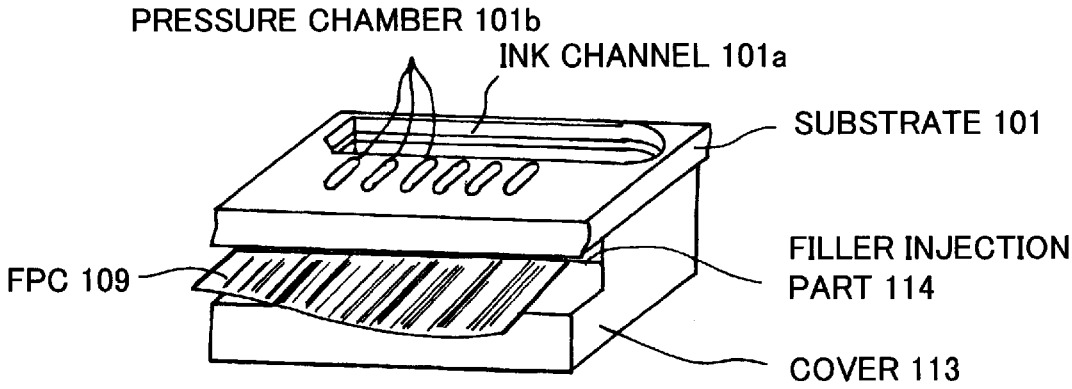
FIGS. 15(A) and 15(B) consist of fourth explanatory drawings of the manufacturing process of the ink jet head of the first embodiment of the present invention.
Figure 15B:
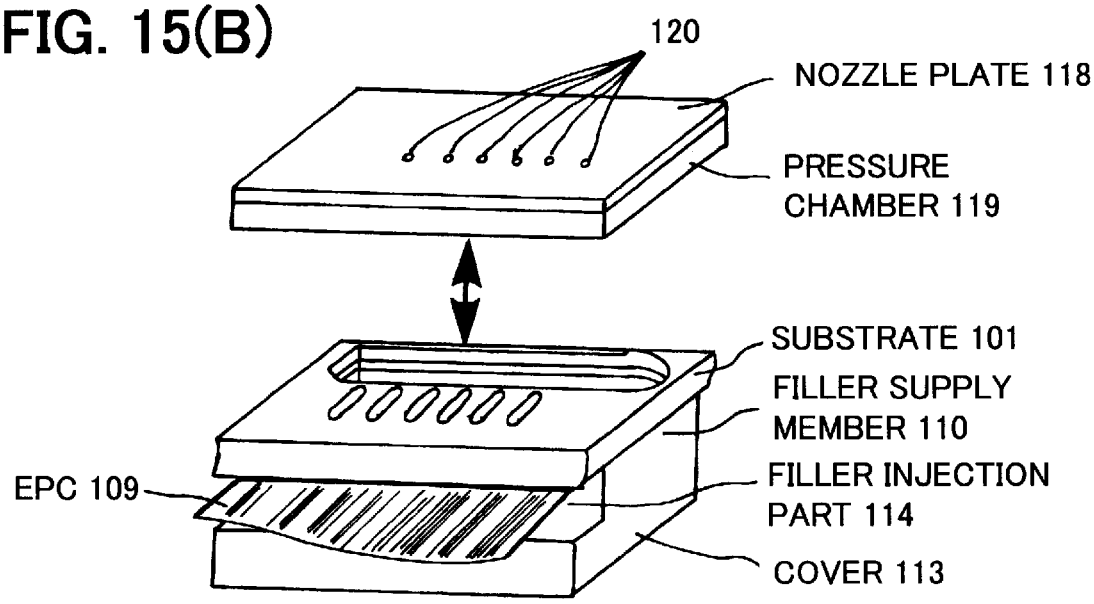

A nozzle plate 118, on the other hand, is formed through a process separate to the above process. As shown in FIG. 15(B), nozzles 120 corresponding to the pressure chambers are formed in the nozzle plate 118. Moreover, pressure chambers and an ink supply channel are formed in a pressure chamber sheet 119. These are formed by Ni electroforming. The sheet 119 and the nozzle plate 118 are joined to the substrate 101, thus completing the head.

Since the bimorph drivers are formed using a sputtering method in this way, thin bimorph drivers can be formed easily. Moreover, because the separate bimorph drivers are formed by milling, bimorph drivers having a narrow width can be formed easily. Furthermore, the slits 3 can be formed by the milling at the same time, and hence the process is simplified. Since the pressure chambers are formed by etching, very small pressure chambers can be formed. As a result, a multi head having a high installation density of 600 dpi or more can be produced easily.

Other Structures of the Ink Jet Head

Figure 16A:
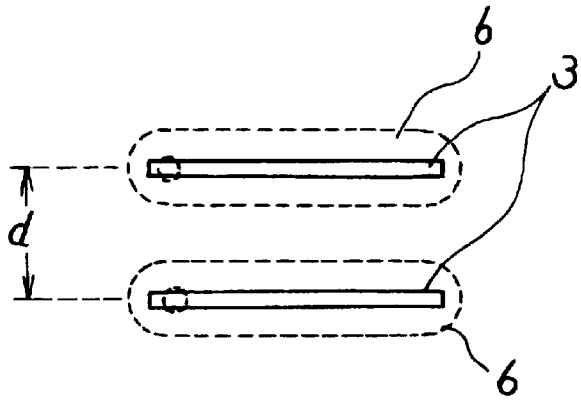
FIGS. 16(A), 16(B) and 16(C) consist of drawings of the constitution of an ink jet head of a fourth embodiment of the present invention.
Figure 16B:
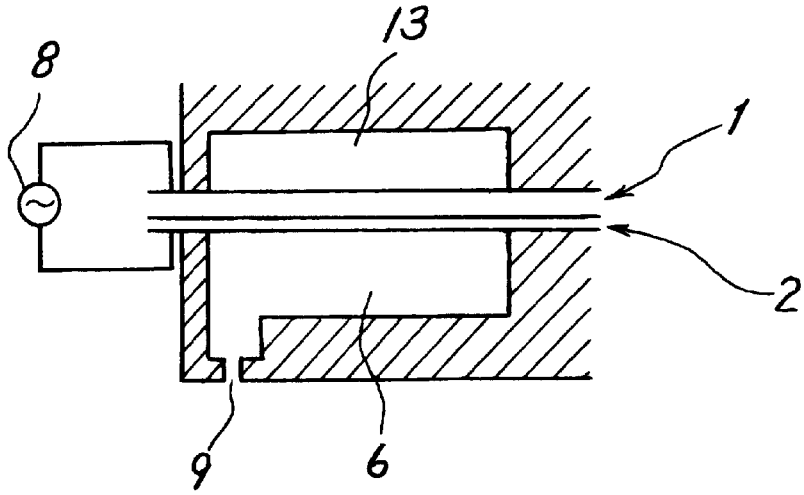
Figure 16C:
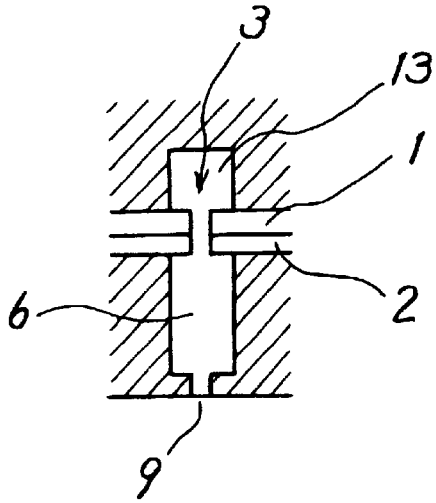
Figure 17:
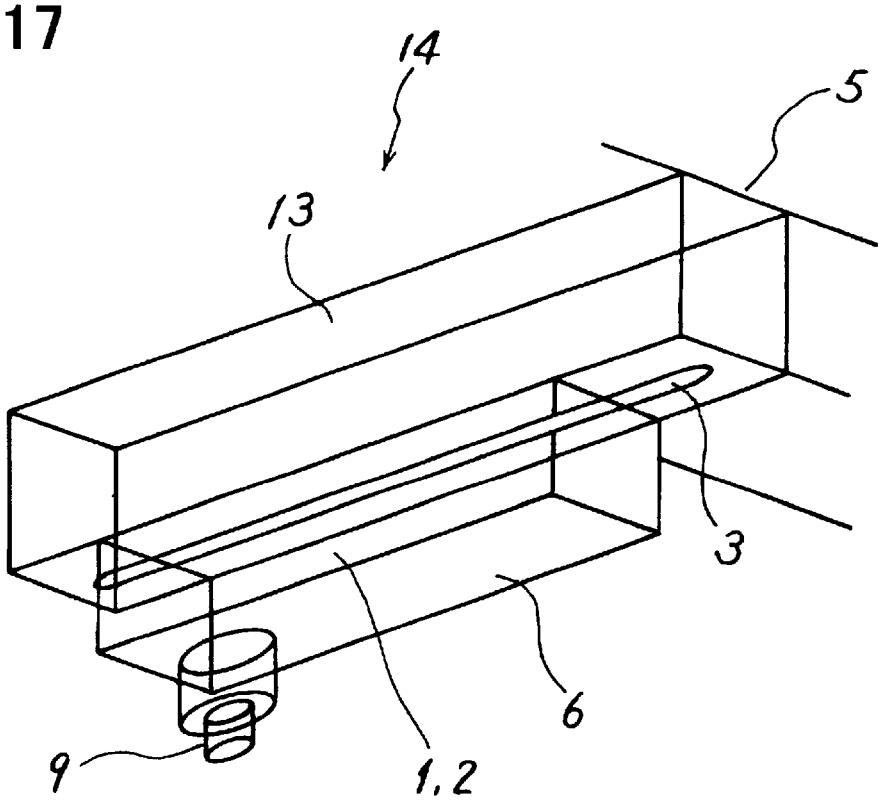
FIG. 17 is a perspective view of the head unit of FIG. 16.
Figure 18:
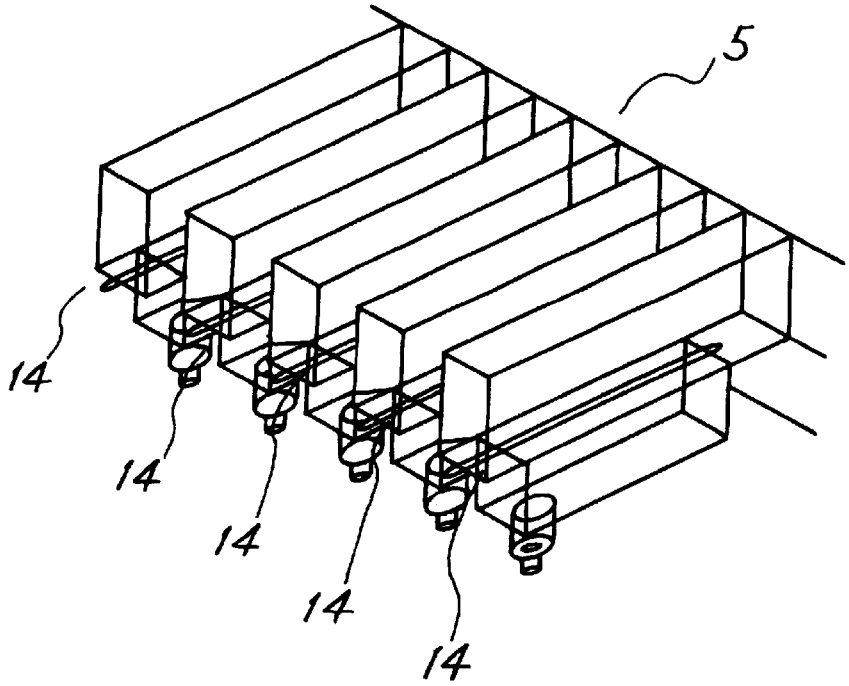
FIG. 18 is a perspective view of part of the multi-nozzle head of FIG. 16.
Figure 19:
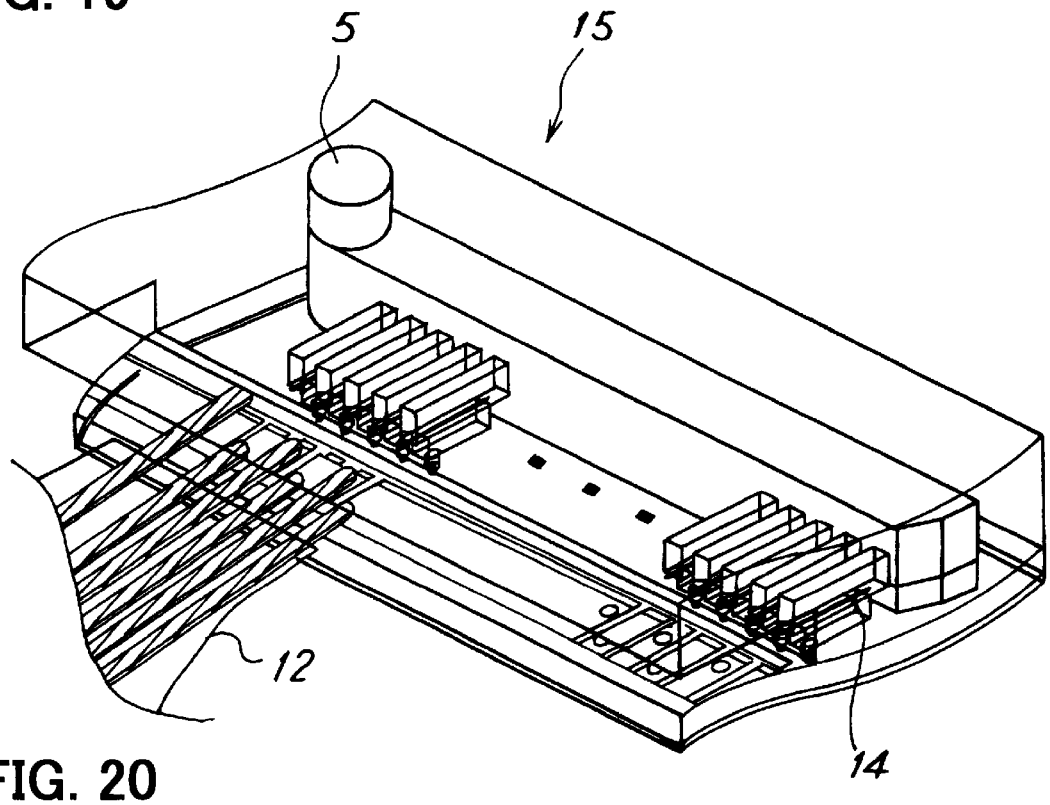
FIG. 19 is a perspective view of the multi-nozzle head of FIG. 16.
Figure 20:
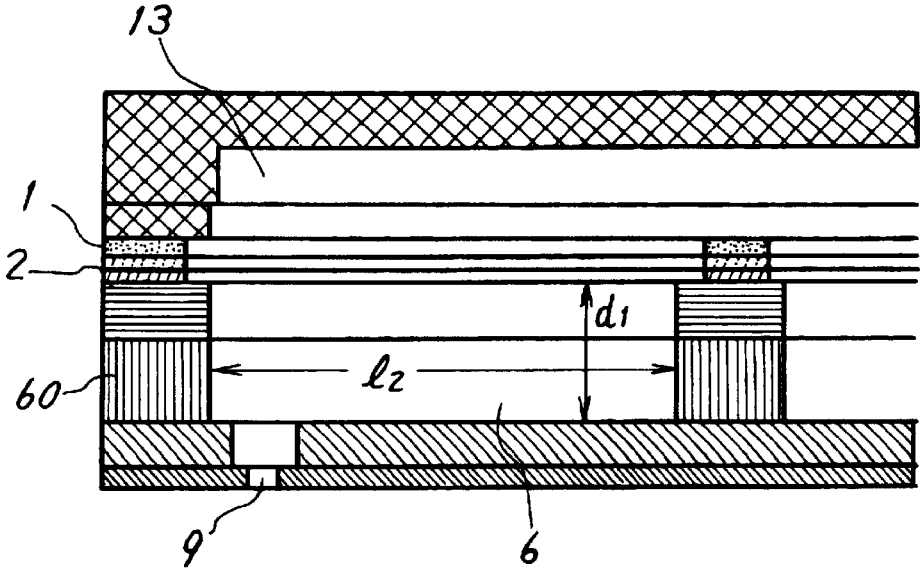
FIG. 20 is a detailed sectional view of the multi-nozzle head of FIG. 16.

FIG. 16 consists of drawings of the constitution of the ink jet head of a fourth embodiment of the present invention, FIG. 17 is a perspective view of the head unit thereof, FIG. 18 is a perspective view of part of the multi-nozzle head, FIG. 19 is a perspective view of the whole of the multi-nozzle head, FIG. 20 is an enlarged sectional view thereof, and FIG. 21 consists of views of the constitution of the ink jet head of a fifth embodiment of the present invention.

FIG. 16(A) is a top view of the multi-nozzle head, FIG. 16(B) is a sectional view thereof, and FIG. 16(C) is a front view thereof. Note that in FIG. 16, elements the same as those shown in FIG. 4 are represented by the same reference numeral.

As shown in FIG. 16(A), FIG. 16(B) and FIG. 16(C), pressure chambers 6 are formed below a vibrating plate 2. A nozzle 9 is provided in each pressure chamber 6. Rectangular piezoelectric plates 1 are provided corresponding to the pressure chambers 6. Slits 3 are provided in the piezoelectric plates 1 and the vibrating plate 2, positioned in the center in the width direction of each piezoelectric plate 1 and running parallel to the long sides of the rectangular shape.

As shown in FIG. 16(B), individual electrodes (not shown) are formed on the piezoelectric bodies 1. The vibrating plate 2 functions as a common electrode. A power source 8 is connected between the vibrating plate 2 and the individual electrode of each piezoelectric plate 1, and a driving voltage is supplied by the power source 8. Moreover, individual ink chambers 13 for supplying ink to the pressure chambers 6 are provided above the piezoelectric plates 1. As shown in FIG. 16(C), the pressure chambers 6 and the individual ink chambers 13 are connected together via slits 3. That is, the opening produced by each slit 3 is used as an ink channel (supply hole) for replenishing ink from an ink tank in an amount corresponding to the amount ejected.

When a driving voltage is applied to one of the piezoelectric bodies 1, the bimorph driver comprising the vibrating plate 2 and the piezoelectric body 1 flexes toward the pressure chamber 6 side. The pressure in the pressure chamber thus rises, and hence ink is ejected from the nozzle 9, and at the same time ink in the slit 3 moves in the same direction as the bimorph driver. As a result, ejection of ink and refilling of ink are carried out simultaneously. The time required for ink refilling in the head can thus be shortened, and hence the response frequency of the head can be made faster.

In this embodiment, the bimorph driver shown in FIG. 1 is used, and hence as mentioned above, even if the width of the piezoelectric body 1 is made narrow, a large displacement amount can be obtained, and ejection of 2- to 3-picoliter ink drops can be carried out. It is thus possible, for example, to set the width of the piezoelectric bodies 1 at 32 $\mu$m, and set the nozzle spacing d shown in FIG. 16(A) at 600 dpi or more.

In the present embodiment, by inserting a slit parallel to one side of the rectangular bimorph structure, the displacement magnification becomes large, and stress is relaxed, and hence a high nozzle installation density can be realized. Moreover, because there is just one slit, processing is simple. The opening produced by inserting the slit in the bimorph structure is used as an ink channel for replenishing ink in an amount corresponding to the amount ejected, and hence the response of the head can be made fast.

Next, a description will be given of embodiments.

FIG. 19 is a perspective view of a multi-nozzle ink jet head. The constitution of the multi-nozzle head 15 is such that 256 head units 14 are provided in a line in a common ink chamber 5. A flexible cable 12 is provided to connect the head units 14 to the outside.

As shown in FIG. 17, the head units 14 have the same constitution as in FIG. 16. That is, the respective pressure chambers 6 are provided under a vibrating plate 2. A nozzle 9 is provided in each pressure chamber 6. Rectangular piezoelectric plates 1 corresponding to the pressure chambers 6 are provided on the vibrating plate 2. Slits 3 are provided in the piezoelectric plates 1 and the vibrating plate 2, positioned in the center in the width direction of each piezoelectric plate 1 and running parallel to the long sides of the rectangular shape. Individual ink chambers 13 are provided via the slits 3 in the piezoelectric bodies 1 and the vibrating plate 2. These individual ink chambers 13 communicate with a common ink chamber 5. FIG. 18 is a drawing showing the continuous arrangement of the head units.

The nozzle pitch in the present embodiment, i.e. the spacing between the head units, is 600 dpi. In addition to a normal water-soluble ink, an oil-based ink or a solid ink can be used as the ink. A water-soluble ink is electrically conductive, and hence there is a risk of shorting between the vibrating plate 2 and the individual electrode of each piezoelectric plate 1. As shown in the fifth embodiment in FIG. 21(A) and FIG. 21(B), the slit 3 part of each piezoelectric body 1 and vibrating plate 2 is thus coated with an insulator 17. In the case of using an oil-based ink or a solid ink, this is not necessary.

Regarding the width of the slits 3, if it is wide then manufacturing is easy, but if it is too wide then pressure escape due to flexing of the member 7 blocking up the slits 3 will become large, and the applied voltage will rise, and also the natural frequency related to the ink ejection (the Helmholtz frequency) and the response frequency of the head will drop. In the present embodiment, the slit width is thus made to be 0.5 microns.

FIG. 20 is a detailed sectional view of the head for explaining the dimensions of the printing head. Table 4 shows the printing head dimensions and the ink ejection performance.

TABLE 4

| Item | Value |
|---|---|
| Nozzle bore ($\mu$m) | 10 |
| Nozzle length ($\mu$m) | 12 |
| Pressure chamber width ($\mu$m) | 32.5 |
| Pressure chamber length ($\mu$m) | 400 |
| Pressure chamber depth ($\mu$m) | 70 |
| Pressure chamber thickness ($\mu$m) | 6.83 |
| Pressure chamber material | Ni |
| Young's modulus of pressure chamber (GPa) | 219 |
| Piezo width ($\mu$m) | 32.5 |
| Slit width ($\mu$m) | 0.5 |
| Piezo thickness ($\mu$m) | 0.4 |
| Vibrating plate thickness ($\mu$m) | 0.3 |
| Insulating film material | Epoxy resin |
| Insulating film thickness ($\mu$m) | 0.01 |
| Applied voltage (V) | 9.0 |
| Particle volume (pl) | 2.0 |
| Particle flying speed (m/s) | 8.0 |

As shown in FIG. 20 and Table 4, the bore n of the nozzles 9 was made to be 10 $\mu$m, and the length 11 12 $\mu$m. The width of the pressure chambers 6 was made to be 32.5 $\mu$m, the length 12 400 $\mu$m, and the depth d1 70 $\mu$m. The thickness of the pressure chamber walls between the pressure chambers 6 shown in FIG. 16(A) was made to be 6.83 $\mu$m. The material of the walls 60 constituting the pressure chambers 6 was made to be Ni, and the Young's modulus of the pressure chambers was made to be 219 GPa. The width W of the piezoelectric bodies ('piezos') 1 was made to be 32.5 $\mu$m, and the thickness 0.4 $\mu$m. The width of the slits 3 was 0.5 $\mu$m. The thickness of the vibrating plate 2 was 0.3 $\mu$m, and the material of the insulating film 17 covering the slits 3 (see FIG. 21) was an epoxy resin, with the thickness being 0.01 $\mu$m. The materials of the vibrating plate 2 and the piezoelectric bodies 1 were made to be Cr and PZT as in Table 1.

A water-based dye ink was used as the ink, with the viscosity thereof being 3.0 cP, the surface tension 0.030N/m, the speed of sound 1550 m/s, and the density 1024 kg/m$^3$.

As shown in Table 4, as a result of adding an applied voltage of 9V to this head, ink drops were ejected with a particle volume of 2.0 pl at a particle flying speed of 8.0 m/s. In this way, even if the width of the piezoelectric bodies 1 is made to be narrow, for example about 30 μm, ink drops of sufficient volume can be obtained at sufficient speed. Thus, even if the width of the piezoelectric bodies 1 is narrowed and the installation density of the head is raised, high-resolution ink jet recording is possible.

Figure 21A:
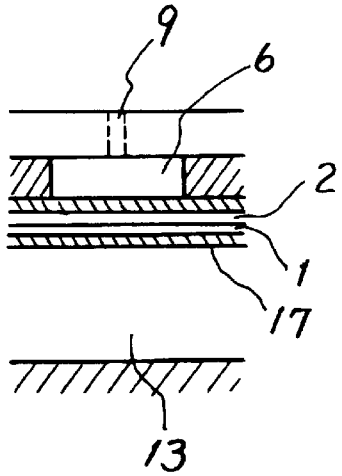
FIGS. 21(A) and 21(B) consist of enlarged views of part of an ink jet head of a fifth embodiment of the present invention.
Figure 21B:
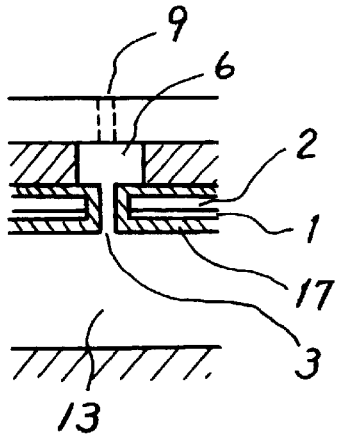
Figure 22A:
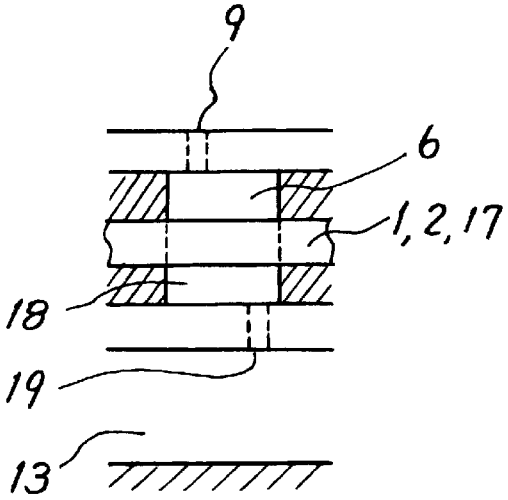
FIGS. 22(A) and 22(B) consist of enlarged views of part of an ink jet head of a sixth embodiment of the present invention.
Figure 22B:
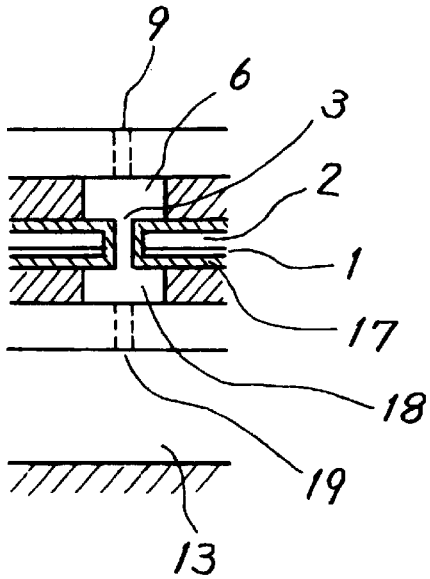

FIG. 22(A) and FIG. 22(B) are enlarged views of ahead of a sixth embodiment of the present invention, this being an example of a modification of the head. In FIG. 22(A) and FIG. 22(B), elements the same as those shown in FIG. 21(A) and FIG. 21(B) are represented by the same reference numerals.

In addition to the constitution of FIG. 21, a second pressure chamber 18 and a supply hole 19 are provided between each pressure chamber 6 and individual ink chamber 13. By making the supply hole 19 and the nozzle 9 have the same dimensions, the acoustic impedance can be made to be approximately the same above and below the driving source 1, 2. A complex transient phenomenon caused by the distributed-constant-related behavior of the ink in the pressure chamber 6 can thus be minimized. As a result, the response speed becomes yet faster. The operating frequency can thus be made faster.

The supply holes 19 were made to have the same dimensions as the nozzles 9, and the second pressure chambers 18 were made to have the same dimensions as the pressure chambers 6. In the case of other dimensions being set as in Table 4, an ink ejection performance the same as in Table 4 was obtained. Note that in the case of using an oil-based ink or a solid ink, the insulating film 17 can be omitted.

Figure 23A:
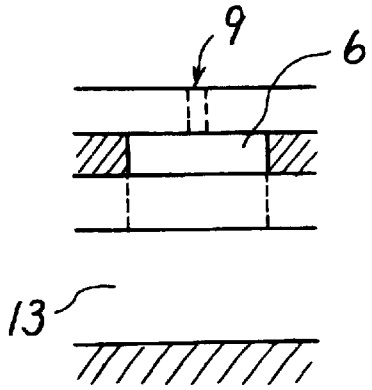
FIGS. 23(A) and 23(B) consist of enlarged views of part of an ink jet head of a seventh embodiment of the present invention.
Figure 23B:
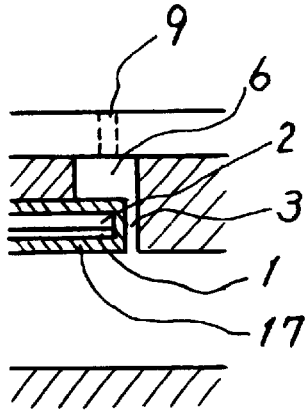

FIG. 23(A) and FIG. 23(B) are enlarged views of ahead of a seventh embodiment of the present invention, and show an example in which the position of the slit 3 is modified. In FIG. 23(A) and FIG. 23(B), elements the same as those shown in FIG. 21(A) and FIG. 21(B) are represented by the same reference numerals.

In this embodiment, the slit 3 is positioned in the vicinity of the wall of each pressure chamber 6. In this embodiment, the deformation amount can be doubled as shown in FIG. 3. The same deformation amount as in FIG. 21 can thus be obtained with the width of the piezoelectric bodies 1 being half of that in FIG. 21. The nozzle pitch can thus be doubled to 1200 dpi.

In the embodiment of FIG. 21, both sides of the slit 3 are a driving source, whereas in the present embodiment, one side of the slit 3 is a fixed part, and hence for the same slit width, the escape of pressure from the slit increases. In the present embodiment, the width of the slits 3 is thus reduced to 0.2 microns. The volumetric displacement of the driving source is the same as in FIG. 21, but the efficiency of energy transfer to the pressure chambers is reduced, and hence the particle volume becomes smaller.

Table 5 shows the printing head dimensions and the ink ejection performance for the present embodiment.

TABLE 5

| Item | Value |
|---|---|
| Nozzle bore (μm) | 5 |
| Nozzle length (μm) | 12 |
| Pressure chamber width (μm) | 16.5 |
| Pressure chamber length (μm) | 800 |
| Pressure chamber depth (μm) | 75 |

TABLE 5-continued

| Item | Value |
|---|---|
| Pressure chamber thickness (μm) | 4.67 |
| Pressure chamber material | TiN |
| Young's modulus of pressure chamber (GPa) | 600 |
| Piezo width (μm) | 16.5 |
| Slit width (μm) | 0.2 |
| Piezo thickness (μm) | 0.4 |
| Vibrating plate thickness (μm) | 0.3 |
| Insulating film material | Epoxy resin |
| Insulating film thickness (μm) | 0.01 |
| Applied voltage (V) | 9.0 |
| Particle volume (pl) | 1.3 |
| Particle flying speed (m/s) | 8.0 |

As shown in Table 5, the bore n of the nozzles 9 was made to be 5 μm, and the length 11 12 μm. The width of the pressure chambers 6 was made to be 16.5 μm, the length 12 800 μm, and the depth d1 75 μm. The thickness of the pressure chamber walls between the pressure chambers 6 was made to be 4.67 μm. The material of the walls 60 constituting the pressure chambers 6 was made to be TiN, and the Young's modulus of the pressure chambers was made to be 600 GPa. The width W of the piezoelectric bodies ('piezos') 1 was made to be 16.5 μm, and the thickness 0.4 μm. The width of the slits 3 was 0.2 μm. The thickness of the vibrating plate 2 was 0.3 μm, and the material of the insulating film 17 covering the slits 3 was an epoxy resin, with the thickness being 0.01 μm. The materials of the vibrating plate 2 and the piezoelectric bodies 1 were made to be Cr and PZT, as in Table 1.

A water-based dye ink was used as the ink, with the viscosity thereof being 3.0 cP, the surface tension 0.030N/m, the speed of sound 1550 m/s, and the density 1024 kg/m$^3$.

As shown in Table 5, as a result of adding an applied voltage of 9V to this head, ink drops were ejected with a particle volume of 1.3 pl at a particle flying speed of 8.0 m/s. In this way, even if the width of the piezoelectric bodies 1 is made to be narrow, for example about 15 μm, ink drops of sufficient volume can be obtained at sufficient speed. A 1200 dpi head can thus be realized.

Note that to obtain the desired displacement amount, as mentioned earlier it is necessary to make the length of the piezoelectric bodies and the length of the pressure chambers long. Furthermore, in the case of using an oil-based ink or a solid ink, the insulating film 17 can be omitted.

Figure 24A:
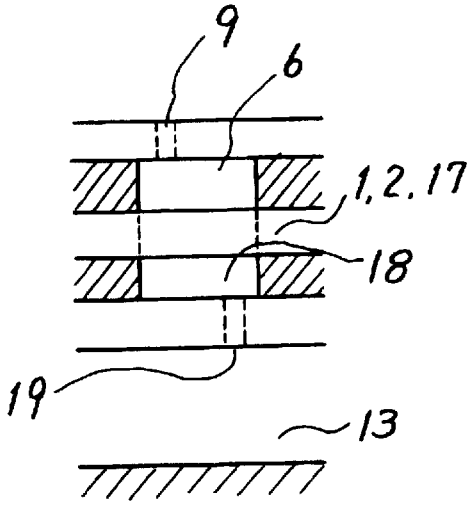
FIGS. 24(A) and 24(B) consist of enlarged views of part of the ink jet head of the seventh embodiment of the present invention.
Figure 24B:
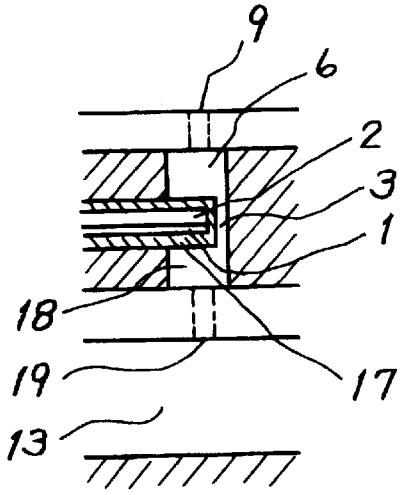

FIG. 24(A) and FIG. 24(B) are enlarged views of a head of an eighth embodiment of the present invention, and show an example in which the position of the slit 3 in the embodiment of FIG. 22 is modified. In FIG. 24(A) and FIG. 24(B), elements the same as those shown in FIG. 22(A) and FIG. 22(B), and FIG. 23(A) and FIG. 23(B), are represented by the same reference numerals.

In this embodiment, the slit 3 is positioned in the vicinity of the wall of each pressure chamber 6, and as in the embodiment of FIG. 22, a second pressure chamber 18 and an ink supply channel 19 are provided between each pressure chamber 6 and ink supply chamber 13. In this embodiment as well, the deformation amount can be doubled as shown in FIG. 3. The same deformation amount as in FIG. 21 can thus be obtained with the width of the piezoelectric bodies 1 being half of that in FIG. 21. The nozzle pitch can thus be doubled to 1200 dpi. Moreover, as described with FIG. 22, the response speed can be increased.

The supply holes 19 were made to have the same dimensions as the nozzles 9, and the second pressure chambers 18 were made to have the same dimensions as the pressure chambers 6. In the case of other dimensions being set as in Table 5, an ink ejection performance the same as in Table 5 was obtained. Furthermore, in the case of using an oil-based ink or a solid ink, the insulating film 17 can be omitted.

Method of Manufacturing other Ink Jet Head

As described above, the piezoelectric bodies 1 of the present head are extremely thin at about 0.4 μm, and hence it is suitable to form them by a sputtering method. Following is a description of the method of manufacturing the head.

FIGS. 25 to 27 show the manufacturing process of the multi-nozzle head of FIGS. 16 to 20.

Figure 25A:
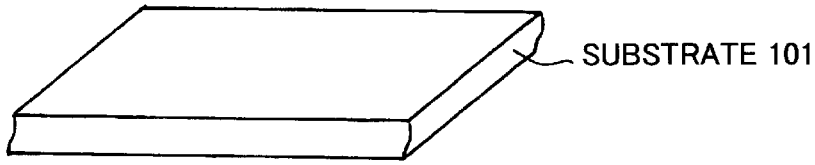
FIGS. 25(A), 25(B), 25(C), 25(D) and 25(E) consist of first explanatory drawings of a manufacturing process of the ink jet head of the fourth embodiment of the present invention.

As shown in FIG. 25(A), a substrate 101 is prepared. A magnesium oxide (MgO) mono-crystal of thickness 0.03 mm is used as the substrate 101. This can be obtained, for example, by fixing a thick substrate of thickness about 300 to 500 μm on a wafer of Si or the like, and making the substrate thinner by polishing or the like. Moreover, the thin substrate may also be obtained by whole surface etching.

Figure 25B:
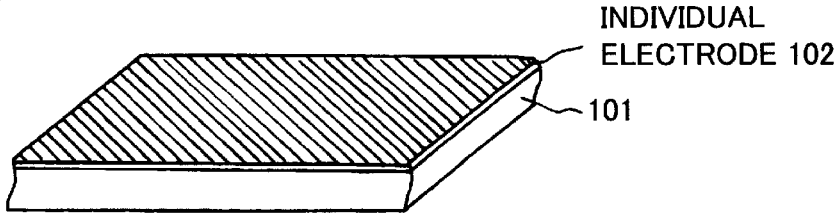
Figure 25C:
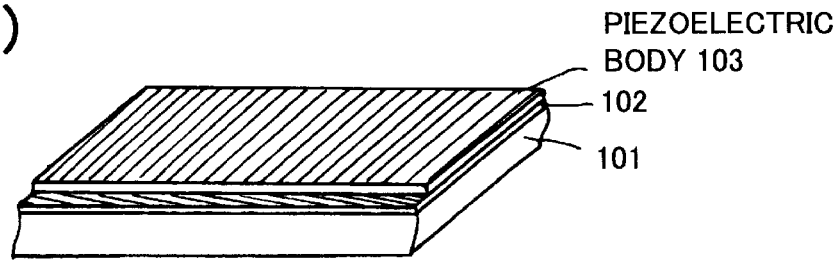
Figure 25D:
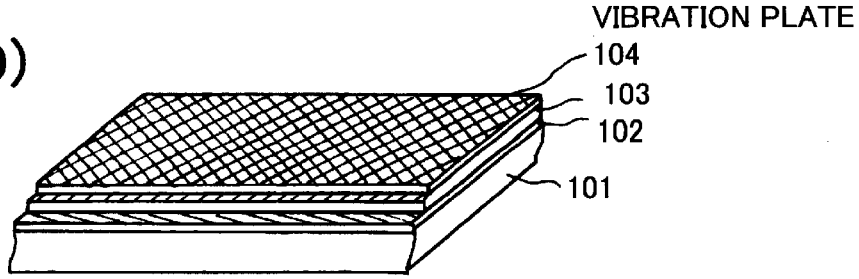

Next, as shown in FIG. 25(B), an electrode layer (individual electrodes) 102 is formed on the substrate 101. Then, as shown in FIG. 25(C), a piezoelectric body layer 103 is formed on the electrode layer 102. Furthermore, as shown in FIG. 12(D), a vibrating plate 104 is formed on the piezoelectric body layer 103. All of these are formed using a sputtering method, which is a thin film formation technique. In the present embodiment, platinum (Pt) is used as the material of the electrode layer 102, and Cr is used as the material of the vibrating plate 104. Here, to expose the individual electrode layer at the edges, and to form an escape for the piezoelectric body layer 103, and furthermore to prevent shorting with the common electrode (vibrating plates) 104, the layers are formed in a stepped fashion.

Figure 25E:
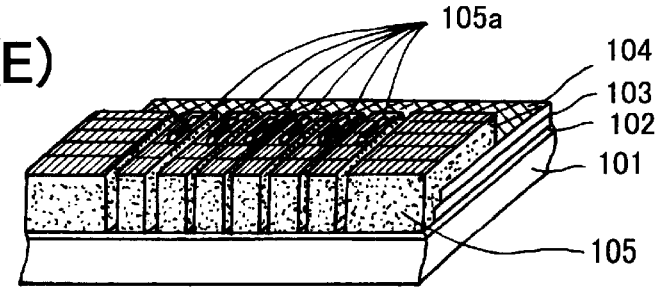

Next, as shown in FIG. 25(E), a milling pattern for dividing the above laminate into parts corresponding to the pressure chambers and forming the slits in the vibrating plates and the piezoelectric bodies is formed using a dry film resist (hereinafter referred to as 'resist pattern') 105. FIG. 25(E) shows the state after the resist pattern 105, including slit parts 105*a*, has been formed; the resist pattern 105 is formed in places where the above-mentioned electrode layer 102, piezoelectric body layer 103 and vibrating plate 104 are to be left behind. In the present embodiment, FR130 (made by Tokyo Ohka Kogyo Co., Ltd.: alkali type resist, thickness 30 μm) was used as the resist pattern, laminating was carried out at 2.5 kgf/cm, 0.5 m/s and 115° C., and then 120 mJ exposure was carried out with a glass mask. Next, preliminary heating at 60° C. for 10 minutes and then cooling to room temperature were carried out, and then developing was carried out with a 1 wt % $Na_2CO_3$ solution, thus forming the pattern.

Figure 26A:
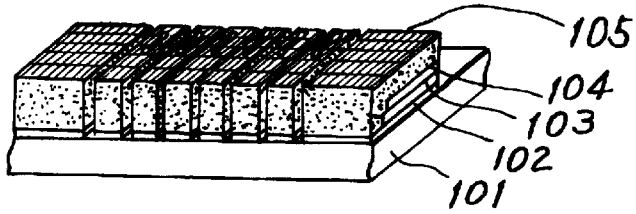
FIGS. 26(A), 26(B), 26(C), 26(D) and 26(E) consist of second explanatory drawings of the manufacturing process of the ink jet head of the fourth embodiment of the present invention.

Next, as shown in FIG. 26(A), this substrate was fixed to a copper holder using grease having good thermal conductivity, and milling was carried out at 700V using Ar gas only with an irradiation angle of −5°. As a result, the shape became as shown in FIG. 26(A), and the taper angle in the depth direction of the milled parts became approximately perpendicular, at an angle of 85° or more, relative to the surface. The state after removal of the resist pattern 105 is shown in FIG. 26(B).

Figure 26B:
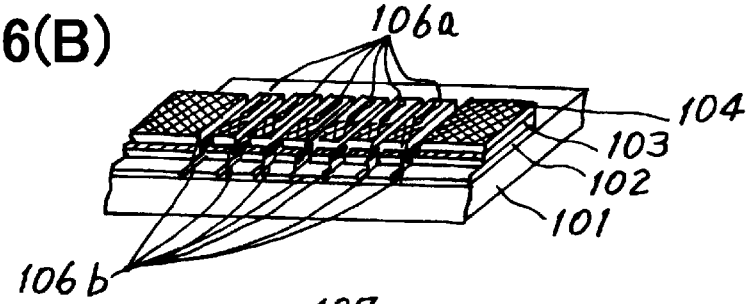

As shown in FIG. 26(B), a plurality of separate bimorph drivers 106*b* are formed on the substrate 101. Each of the individual bimorph drivers 106*b* is formed from an individual electrode 102, a piezoelectric body 103 and a common electrode (vibrating plate) 104 laminated together. Moreover, a slit 106*a* is formed in the center of each of the bimorph drivers 106*b*.

Figure 26C:
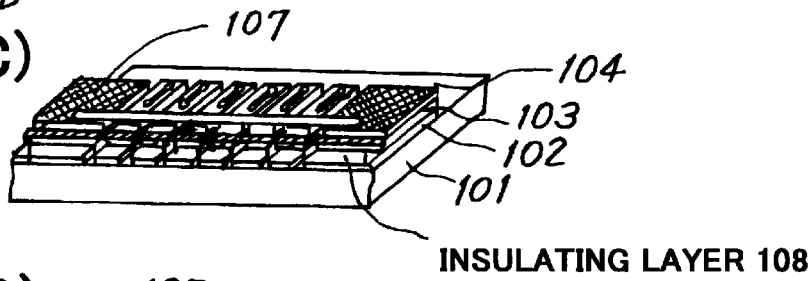

Next, as shown in FIG. 26(C), the divided vibrating plates 104 are electrically connected to one another by an electrode 107, thus making the vibrating plates 104 into a common electrode. To form the electrical connection parts of the individual electrodes 102, an insulating layer 108 is then formed on the above-mentioned stepped parts. In the present embodiment, a photosensitive polyimide was used as the insulating layer 108. Contact holes were formed in the parts of the insulating layer 108 corresponding to the individual electrodes.

Figure 26D:
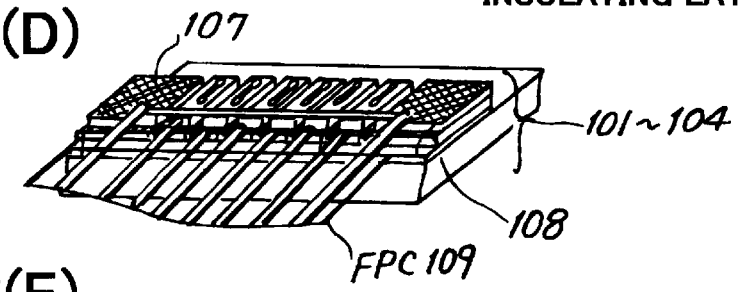

Next, as shown in FIG. 26(D), to connect the above-mentioned individual electrodes 102 and the vibrating plates (common electrode) 104 to the outside, an FPC (flexible cable) 109 is connected to the individual electrodes 102 and the vibrating plates (common electrode) 104. At this time, a contact is formed on each of the individual electrodes 102 by placing gold (Au) balls on each of the contact holes in the insulating layer 108 or carrying out plating, and connection to the end of the FPC 109 is carried out all at once.

Figure 26E:
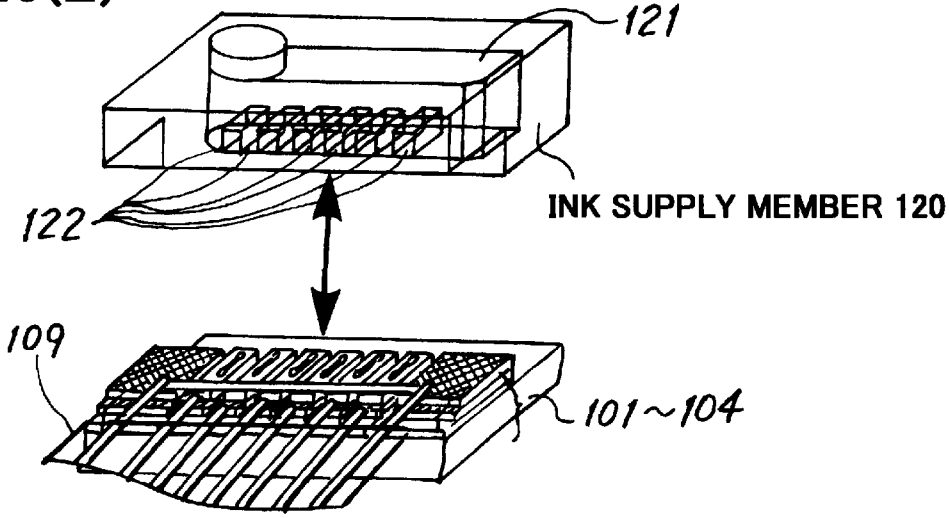

Next, as shown in FIG. 26(E), an ink supply member 120 in which are formed individual ink chambers 122 and a common ink chamber 121 is prepared. The individual ink chambers 122 in the ink supply member 120 are very small, and are thus formed by electroforming or the like. Moreover, a glass-fiber-added molded article is used as a lid part of the ink supply member 120. In FIG. 26(E), the parts formed by electroforming and the molded part are shown as a single body. Alignment is carried out such that the individual ink chambers 122 are positioned over the slits 106*a* of the bimorph drivers 106*b*, and the ink supply member 120 is bonded to the vibrating plates 104.

Figure 27A:
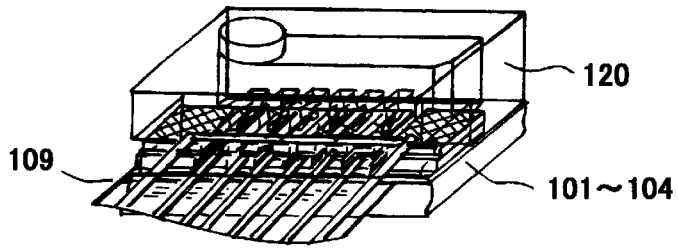
FIGS. 27(A), 27(B), 27(C), 27(D) and 27(E) consist of third explanatory drawings of the manufacturing process of the ink jet head of the fourth embodiment of the present invention.

Next, as shown in FIG. 27(A), after joining and fixing, adhesive/fixative is injected into the space between the connecting part of the FPC 109 and the ink supply member 120, thus strengthening the electrical contacts and the whole. In the present embodiment, a heat-resistant curing resin (Ablebond 342-3) was used. Another filler or curing resin may be used, so long as it is heat-resistant.

Figure 27B:
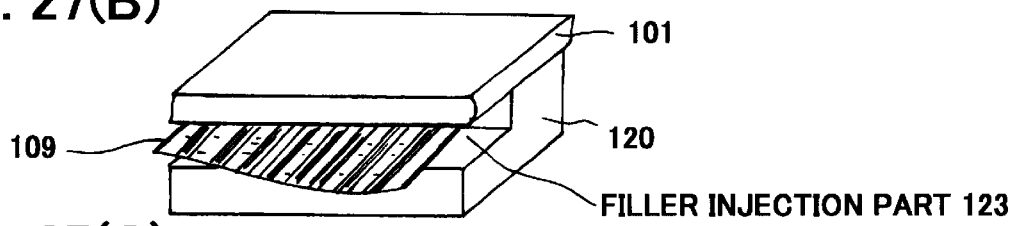

As shown in FIG. 27(B), filler 123 is filled into the joining part of the FPC 109 in this way, thus filling the gap between the joining part of the FPC 109 and the ink supply member 120, and securing a strength sufficient for withstanding joining in a subsequent step, and then the whole is turned over, thus making the surface of the substrate 101 be the top side.

Figure 27C:
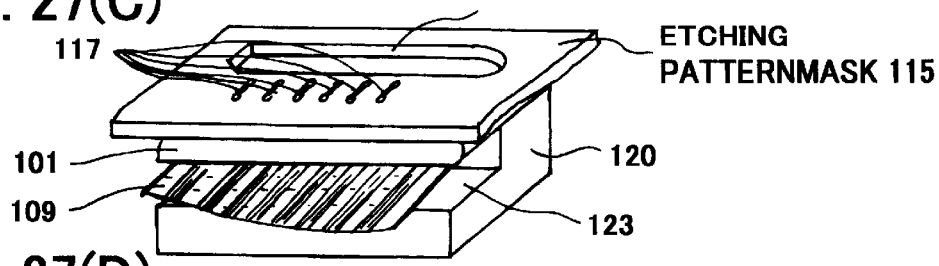
Figure 27D:
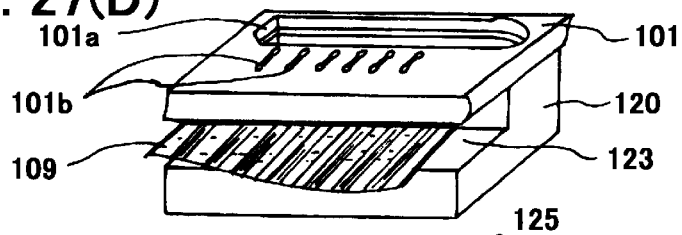

Next, as shown in FIG. 27(C), an etching pattern mask 115 for forming the pressure chambers is bonded to a piezoelectric body modified part of the substrate 101. This etching pattern mask 115 has pressure chamber parts 117 and an ink channel part 116. The etching pattern mask 115 used in the present embodiment was REVAALPHA made by Nitto Denko Corporation. In the milling carried out to form the above-mentioned divided bimorph drivers 106*b*, alignment marks (not shown) were formed at the same time. The alignment between the etching pattern mask 115 and the substrate 101 is carried out using these alignment marks. Because the substrate 101, which is an MgO substrate, is a transparent body, the alignment can be carried out easily. Moreover, the etching pattern mask 115 has a large area, so that during etching of the substrate 101, the etching liquid will not come into contact with the FPC 109 or the ink supply member 120.

Next, etching was carried out by immersing for 40 minutes using an 80° C. 80% phosphoric acid solution. After this, washing with water and drying were carried out, then the head was put onto a 170° C. hotplate such that the etching pattern mask 115 surface came into contact with the hot plate, and the mask 115 only was peeled off. As shown by the head after the peeling off in FIG. 27(D), separate pressure chambers 101*b* and an ink channel 101*a* were formed.

Figure 27E:
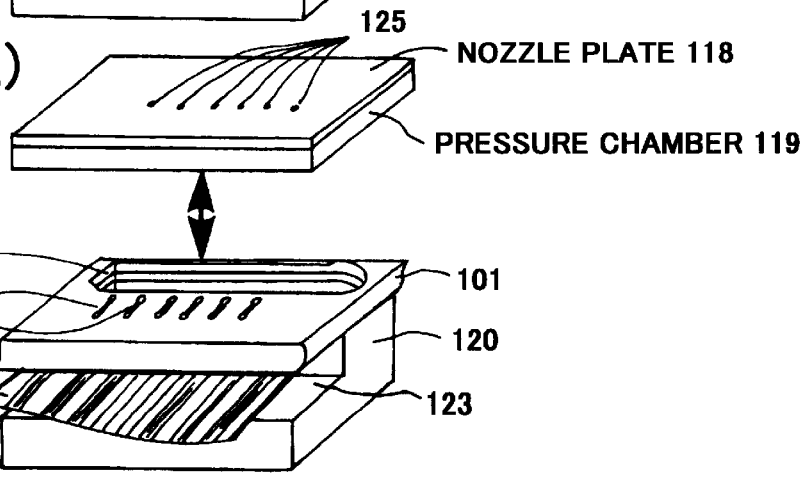
Figure 28A:
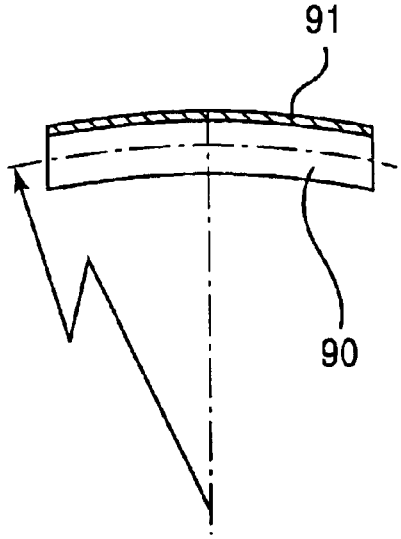
FIG. 28(A) PRIOR ART
FIGS. 28(A), 28(B) and 28(C) consist of explanatory drawings of a conventional bimorph structure ink jet head.
Figure 28B:
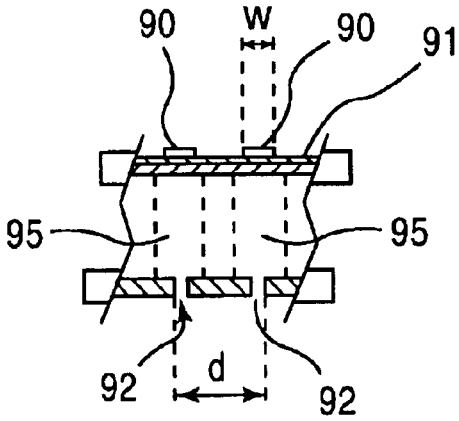
FIG. 28(B) PRIOR ART
Figure 28C:
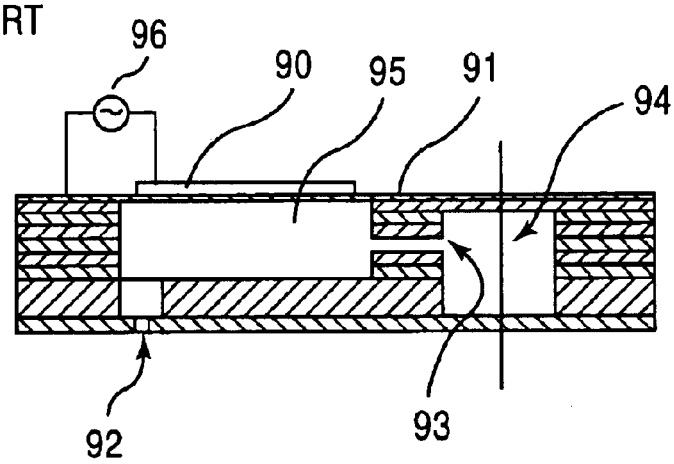
FIG. 28(C) PRIOR ART
Figure 29A:
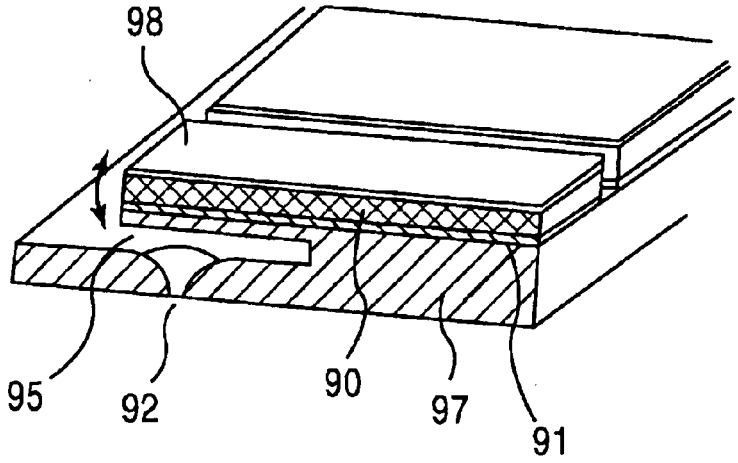
FIG. 29(A) PRIOR ART
FIGS. 29(A) and 29(B) consist of explanatory drawings of a conventional cantilever beam structure ink jet head.
Figure 29B:
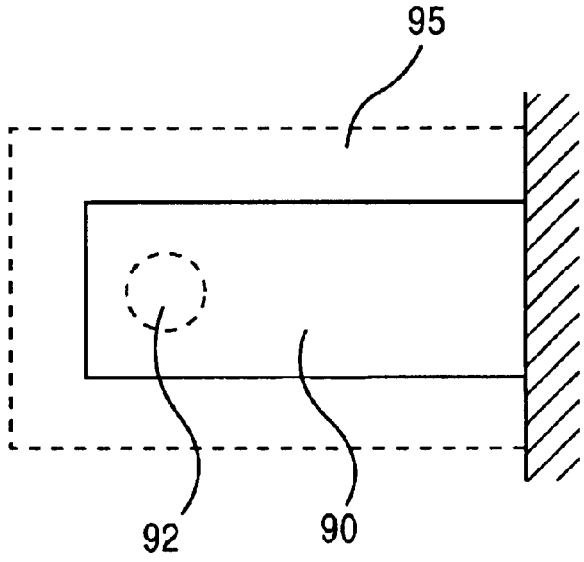
FIG. 29(B) PRIOR ART

A nozzle plate 118, on the other hand, is formed through a process separate to the above process. As shown in FIG. 27(E), nozzles 125 corresponding to the pressure chambers are formed in the nozzle plate 118. Moreover, pressure chambers and an ink supply channel are formed in a pressure chamber sheet 119. These are formed by Ni electroforming. The sheet 119 and the nozzle plate 118 are joined to the substrate 101, thus completing the head.

Since the bimorph drivers are formed using a sputtering method in this way, thin bimorph drivers can be formed easily. Moreover, because the separate bimorph drivers are formed by milling, bimorph drivers having a narrow width can be formed easily. Furthermore, the slits 3 can be formed by the milling at the same time, and hence the process is simplified. Since the pressure chambers are formed by etching, very small pressure chambers can be formed. As a result, a multi head having a high installation density of 600 dpi or more can be produced easily.

In the above embodiments, a monochrome ink jet head was described as an example, but application to a color ink jet head is also possible. Moreover, the nozzles were provided below the pressure chambers, but may also be provided on the sides of the pressure chambers.

The present invention has been described through the embodiments above; however, various modifications are possible within the scope of the purport of the present invention, and these are not excluded from the scope of the present invention.

Industrial Applicability

As described above, in the present invention, three peripheral sides of a bimorph driver that has a piezoelectric body 1 and a vibrating plate 2 and that is for applying pressure to a pressure chamber are fixed and the other side is made to be free, and hence tensile stress in the piezoelectric body can be released without pressure leakage. As a result, the displacement and pressure required for ejecting ink drops can be obtained even if the width of the piezoelectric body is narrow. A high-density multi-nozzle head can thus be realized.

What is claimed is:

1. An ink jet head for ejecting ink drops from a nozzle, comprises:

a pressure chamber that communicates with said nozzle and stores ink; and a bimorph driver forming a side of said pressure chamber and having a piezoelectric body and a vibrating plate operative for applying pressure to said pressure chamber, wherein three peripheral sides of said bimorph driver are fixedly supported with respect to said pressure chamber and another one side of said bimorph driver is free with respect to said pressure chamber.

2. The ink jet head according to claim 1, wherein said bimorph driver has a slit.

3. The ink jet head according to claim 2, wherein said slit is provided parallel to one side of said bimorph driver.

4. The inkjet head according to claim 3, wherein said slit is provided in the center of said bimorph driver.

5. The ink jet head according to claim 2, wherein said head further has a filling member for blocking up the slit of said bimorph driver.

6. The ink jet head according to claim 2, wherein said head further has an ink tank that communicates with said pressure chamber via said slit.

7. A multi-nozzle ink jet head for ejecting ink drops from individual nozzles, comprises:

a plurality of pressure chambers that each communicates with an associated nozzle and stores ink; and a plurality of bimorph drivers forming a side of an associated pressure chamber and that each has a piezoelectric body and a vibrating plate for applying pressure to said pressure chambers; and an ink tank that communicates with said plurality of pressure chambers, and wherein three peripheral sides of each of said bimorph drivers are fixedly supported with respect to said associated pressure chamber and another one side of each bimorph driver is free with respect to said pressure chamber.

* * * * *